US006545423B2

(12) United States Patent
Sakita et al.

(10) Patent No.: US 6,545,423 B2
(45) Date of Patent: Apr. 8, 2003

(54) APPLIED VOLTAGE SETTING METHOD AND DRIVE METHOD OF PLASMA DISPLAY PANEL

(75) Inventors: Koichi Sakita, Kawasaki (JP); Kenji Awamoto, Kawasaki (JP); Yasunobu Hashimoto, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/729,318

(22) Filed: Dec. 5, 2000

(65) Prior Publication Data

US 2001/0019246 A1 Sep. 6, 2001

(30) Foreign Application Priority Data

Feb. 29, 2000 (JP) ..... 2000-052738

(51) Int. Cl.[7] ..... G09G 3/10

(52) U.S. Cl. ..... 315/169.3; 315/169.4; 345/60; 345/63; 345/67

(58) Field of Search ..... 315/169.3, 169.4; 345/60, 63, 67, 204, 208, 211

(56) References Cited

U.S. PATENT DOCUMENTS 5,745,086 A 4/1998 Weber ..... 345/63
5,835,072 A * 11/1998 Kanazawa ..... 345/60
6,054,970 A * 4/2000 Hirakawa et al. ..... 345/60
6,144,348 A * 11/2000 Kanazawa et al. ..... 315/169.1
6,144,349 A * 11/2000 Awata et al. ..... 345/67
6,150,766 A 11/2000 Shino et al. ..... 315/169.4
6,175,194 B1 * 1/2001 Saegusa et al. ..... 315/169.1
6,232,935 B1 * 5/2001 Fukushima et al. ..... 345/67
6,292,159 B1 * 9/2001 Someya et al. ..... 345/60

FOREIGN PATENT DOCUMENTS

JP 08-212930 8/1996

* cited by examiner

*Primary Examiner*—Don Wong
*Assistant Examiner*—Thuy Vinh Tran
(74) *Attorney, Agent, or Firm*—Staas & Halsey LLP

(57) ABSTRACT

A method for setting an applied voltage in a plasma display panel is provided, in which a driving voltage margin is increased. A charge adjustment is performed by generating a discharge for changing a wall charge quantity without changing a polarity of the charging before addressing. In a coordinates space describing the relationship between the effective voltage between the first electrodes and the effective voltage between the second electrodes, a voltage range (Vt closed curve) that can generate a microdischarge for the charge adjustment is determined, and a waveform of an increasing voltage that is applied to the discharge cell is determined in accordance with a Vt closed curve.

17 Claims, 36 Drawing Sheets

FIG. 8
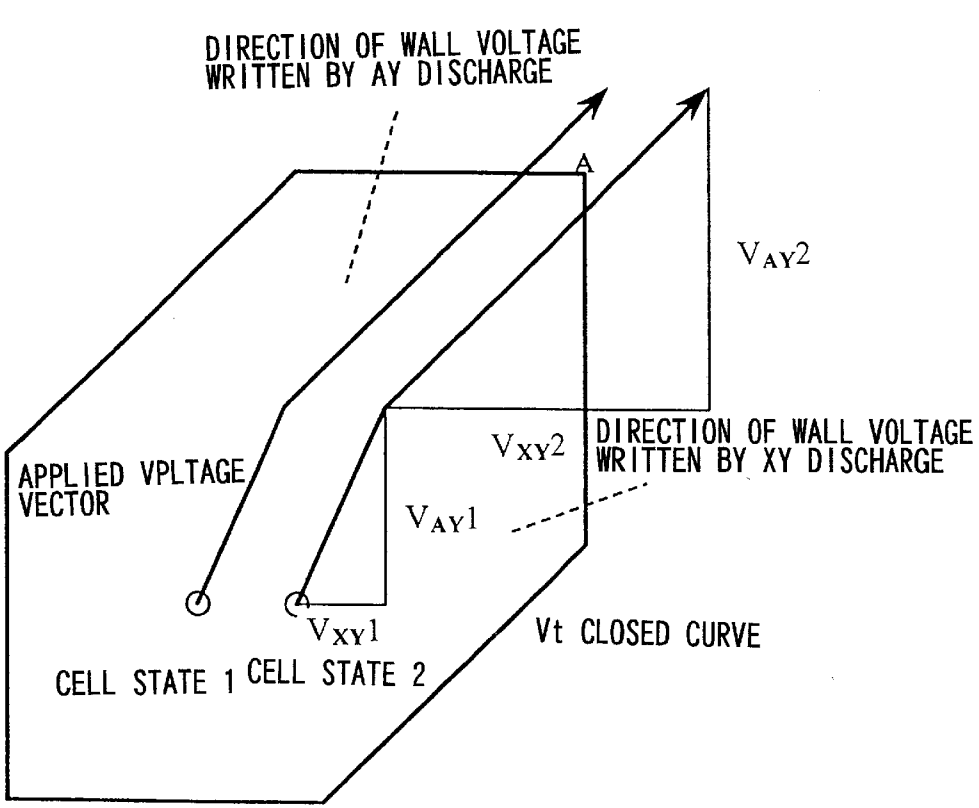
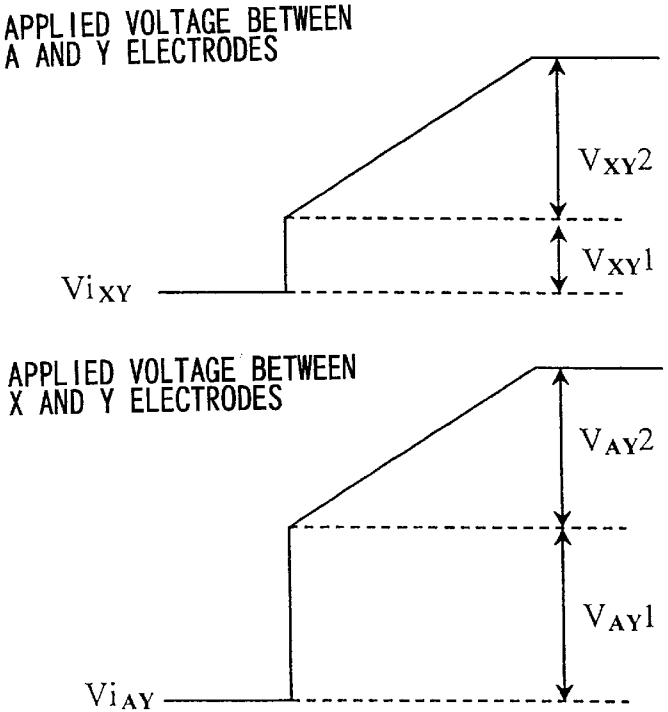

FIG. 37 *PRIOR ART*
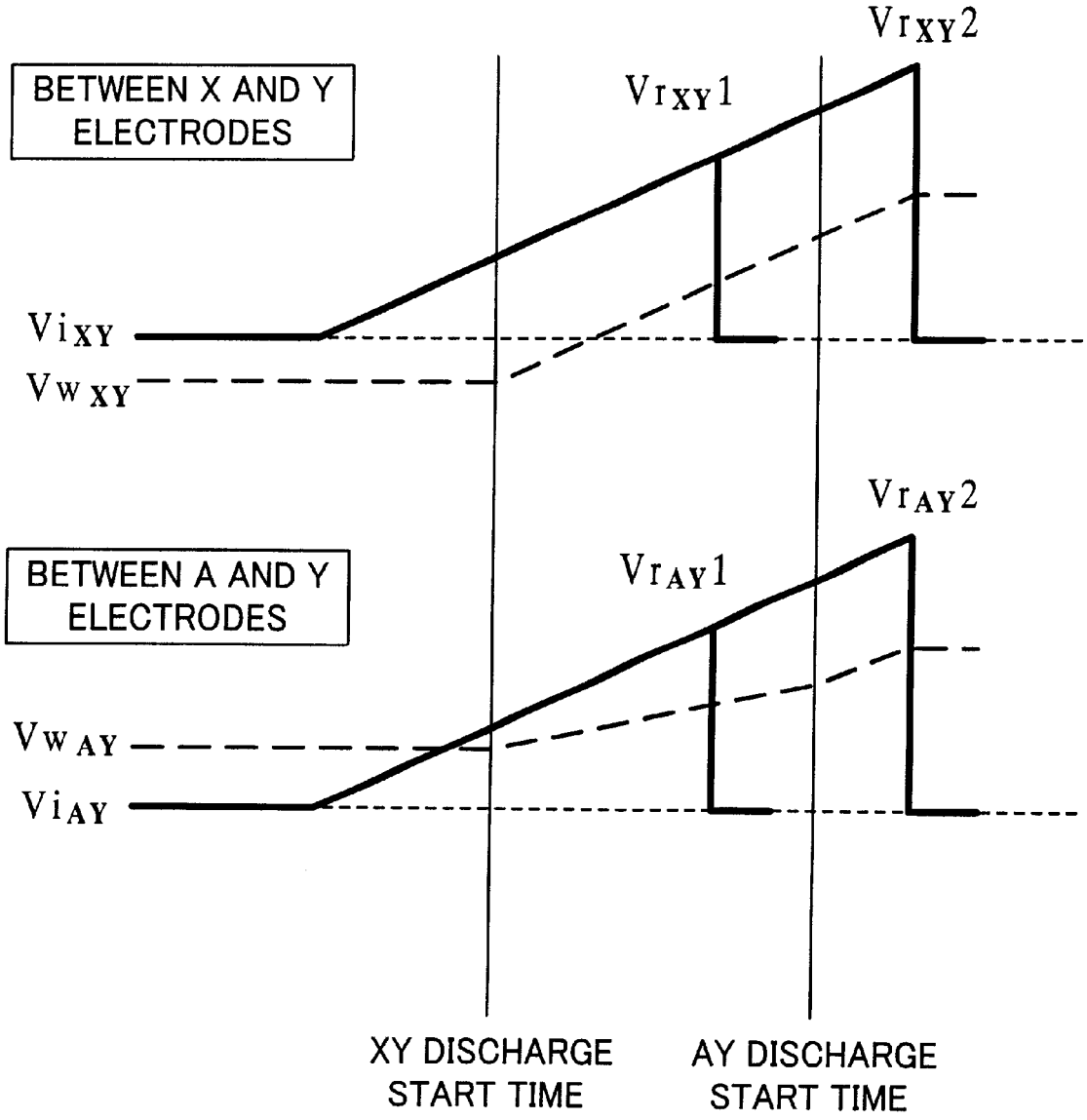

APPLIED VOLTAGE SETTING METHOD AND DRIVE METHOD OF PLASMA DISPLAY PANEL

BACKGROUND OF THE INVENTION

1. Field of the Invention

The present invention relates to a method for setting an applied voltage in a plasma display panel (PDP) and a method for driving the PDP. The methods are suitable for driving a surface discharge type PDP. In the surface discharge type, display electrodes (a first electrode and a second electrode), which are an anode and a cathode in a display discharge for securing a luminance, are arranged in parallel on a substrate of the front or the back side.

In a PDP, it becomes difficult to equalize the structure of cells while a screen becomes large, and a smaller cell has more influence to the discharge characteristics of a cell structure having a delicate difference. In order to promote development of a PDP having a larger screen and a high resolution, a driving method is necessary that has a sufficient margin of voltage for permitting a variance of characteristics.

2. Description of the Prior Art

A typical surface discharge type PDP has a three-electrode structure in which an address electrode (a third electrode) is arranged to cross a pair of display electrodes. The basic structure of the three-electrode structure has a pair of display electrodes for each row of the screen. In other electrode structure, when the number of rows of the screen is n, n+1 display electrodes are arranged at a constant pitch, and neighboring electrodes constitute the electrode pair for generating the surface discharge. In any case, a cell that is a display element (a discharge cell) has three electrodes whose potential can be controlled independently.

A memory function of a dielectric layer covering the display electrode pair is utilized for display. Namely, a row scan addressing is performed for generating a charged state in accordance with the display contents, and then a sustaining voltage Vs having an alternating polarity is applied to the display electrode pair of each row. The second electrode is used as a scan electrode, and the third electrode is used as a data electrode for addressing.

The sustaining voltage Vs satisfies the following inequality.

$$Vf-Vw<Vs<Vf$$

Vf is a start voltage of a sustaining discharge.

Vw is a wall voltage between electrodes.

The application of the sustaining voltage Vs generates a surface discharge along the substrate surface only in cells having a wall charge when the cell voltage (an effective voltage that is a voltage to be applied to the electrode plus the wall voltage) exceeds the discharge start voltage Vf.

A discharge cell of a PDP is a binary light emission element. A drive system of a PDP reproduces a halftone by setting an integral light emission quantity of each discharge cell for each frame in accordance with the gradation value. A color display is a kind of gradation display, and its display color is determined by a combination of luminance values of three primary colors. For the gradation display, a method is used in which one field includes plural sub fields weighted by the luminance, and the integral light emission quantity is set by a combination of on and off of the light emission for each subfield. In order to perform 256-step gradation display for example, a frame is divided into eight subframes having 1, 2, 4, 8, 16, 32, 64 or 128 weight of the luminance. In general, the weighting of the luminance can be set as the number of light emissions. The field means a unit image of time series of image display. In an interlace format the field constitutes a frame, while in a non-interlace format the field corresponds a frame.

An address period for addressing, a sustaining period for generating display discharges plural times corresponding to the weight of the luminance, and a period for an initialization for equalizing the charged state of the entire screen before the addressing (a preparation period for addressing) are assigned to a subfield. When the sustaining period finishes, discharge cells having relatively much wall charge and discharge cells having almost no wall charge are mixed. Therefore, the initialization is performed as the preparation process for increasing the reliability of the addressing.

U.S. Pat. No. 5,745,086 discloses the initialization step in which a first and a second ramp voltages are applied to the discharge cell sequentially. The application of the ramp voltage having a gentle gradient can make the light quantity of the light emission substantially zero in the initialization because of the characteristics of a microdischarge that will be explained below, so that a contrast is prevented from dropping. In addition, the wall voltage can be set to any target value despite the variance of the cell structure.

If the gradient of the ramp voltage is gentle, plural charge adjustment microdischarges occur while the applied voltage rises. When the gradient becomes gentler, the discharge intensity becomes smaller, and the discharge period becomes shorter, so that the discharge form transfers to a continuous form. Hereinafter, the word "microdischarge" means both a cyclic charge adjustment discharge and a continuous charge adjustment discharge.

In the microdischarge, the wall voltage can be set only by a peak voltage value of a ramp wave. It is because during the microdischarge, even if a cell voltage Vc (i.e., the wall voltage Vw plus the applied voltage Vi) that is applied to the discharge space exceeds a discharge starting threshold value (hereinafter, referred to as the voltage Vt) due to an increase of the ramp voltage, the cell voltage is always maintained at the voltage near the voltage Vt due to a generation of the microdischarge. The microdischarge decreases the wall voltage by substantially the same level as the increase of the ramp voltage. When Vr is the final value of the ramp voltage, and Vw is the wall voltage when the ramp voltage reaches the final value Vr, the following relationship holds. Namely, since the cell voltage Vc is maintained to be the voltage Vt, $$Vc=Vr+Vw=Vt,$$

and therefore, $$Vw=-(Vr-Vt)$$

Since the voltage Vt is a constant value determined by the electric characteristics of the discharge cell, the wall voltage can be set to any target value by setting the final value Vr of the ramp voltage. Specifically, even if there is a delicate difference of the voltage Vt between the discharge cells, the difference between the voltages Vt and Vw can be equalized for all discharge cells.

In the conventional driving method, an application of a first ramp voltage generates a wall charge between the first electrode and the second electrode (hereinafter, referred to as between X and Y electrodes) as well as between the second electrode and the third electrode (hereinafter, referred to as between A and Y electrodes). After that, a second ramp voltage is applied so that the wall voltages between X and Y electrodes and between A and Y electrodes can approach the target value. The amplitude of the first ramp voltage is set to such a value that the second ramp voltage can always cause the microdischarge.

The conventional initialization will be explained in detail with reference to FIG. 36. FIG. 36 shows a variation of the voltages between X and Y electrodes and between A and Y electrodes with respect to the second electrode. It should be noted that the wall voltages between X and Y electrodes and between A and Y electrodes are plotted by the inverted polarity. Thus, the cell voltage between X and Y electrodes and the cell voltage between A and Y electrodes can be read directly from the difference between the waveform of the applied voltage Vi and the waveform of the wall voltage Vw. Namely, the distance between the plot position of the applied voltage Vi and the plot position of the wall voltage Vw at any time point indicates the absolute value of the cell voltage. Concerning the wall voltage Vw, in the previous subfield that was displayed before the subfield to be initialized, the voltage change when the noted cell is lighted is drawn by the broken line, while the voltage change when the noted cell is not lighted is drawn by the chain line. It is supposed that the absolute value of the wall voltage $Vw_{XY}$ between X and Y electrodes is larger in the cell that was lighted than in the cell that was not lighted in the previous subfield and the absolute value of the wall voltage $Vw_{AY}$ between A and Y electrodes is smaller in the cell that was lighted than in the cell that was not lighted in the previous subfield. Actually, the wall voltage Vw at the start of the initialization depends on the number of the display pulses in the previous subfield and the polarity of the voltage applied at the end of the display process, so there can be a situation where the relationship of the wall voltages between the lighted case and the not lighted case in the previous subfield is different from the illustrated relationship. In addition, the value of the wall voltage Vw has a variation to some extent.

In the case where the cell was lighted in the previous subfield, the cell voltage between X and Y electrodes reaches the discharge starting threshold value (hereinafter, referred to as the voltage $Vt_{YX}$) between X and Y electrodes at the time point A in the figure. Therefore, from the time point A to the end of the application of the first ramp voltage, the microdischarge maintains the cell voltage between X and Y electrodes at the voltage $Vt_{YX}$. After the time point A the discharge between X and Y electrodes (hereinafter, referred to as XY discharge) is ascendant for some period. In this period, the wall voltage $Vw_{XY}$ between X and Y electrodes changes mainly. However, the wall voltage $Vw_{AY}$ between A and Y electrodes also changes a little. While the applied voltage $Vi_{XY}$ between X and Y electrodes as well as the applied voltage $Vi_{AY}$ between A and Y electrodes increases after the time point A (the polarity is negative in the figure), the cell voltage between A and Y electrodes increases though the cell voltage between X and Y electrodes is maintained at the voltage $Vt_{YX}$. After the cell voltage between A and Y electrodes reaches the discharge starting threshold value (hereinafter, referred to as the voltage $Vt_{YA}$) at the time point B in the figure, the cell voltage between A and Y electrodes is maintained at the voltage $Vt_{YA}$ until the application of the first ramp voltage is finished. When $-Vr_{XY}1$ is the final value of the first ramp voltage between X and Y electrodes, and $-Vr_{AY}1$ is the final value between A and Y electrodes, the wall voltage $Vw_{XY}$ between X and Y electrodes at the end time point of the first ramp voltage is $Vr_{XY}1-Vt_{YX}$, and the wall voltage $Vw_{AY}$ between A and Y electrodes is $Vr_{AY}1-Vt_{YA}$.

In the case where the cell was not lighted in the previous subfield, the cell voltage between A and Y electrodes reaches the discharge starting threshold value the voltage $Vt_{YA}$ between A and Y electrodes at the time point E in the figure. After the time point E till the end of the application of the first ramp voltage, the cell voltage between A and Y electrodes is maintained at the voltage $Vt_{YA}$. During the period while the discharge between A and Y electrodes (hereinafter, referred to as AY discharge) is ascendant, the wall voltage $Vw_{AY}$ between A and Y electrodes changes mainly. However, the wall voltage $Vw_{XY}$ between X and Y electrodes also changes a little. While the applied voltages $Vi_{XY}$, $Vi_{AY}$ increase after the time point E, the cell voltage between X and Y electrodes increases though the cell voltage between A and Y electrodes is maintained at the voltage $Vt_{YA}$. After the cell voltage between X and Y electrodes reaches the voltage $Vt_{YX}$ at the time point F in the figure, the cell voltage between A and Y electrodes is maintained at the voltage $Vt_{YA}$ until the application of the first ramp voltage is finished. Therefore, in the same way as the case where the cell was lighted in the previous subfield, the wall voltage $Vw_{XY}$ between X and Y electrodes at the end time point of the first ramp voltage is $Vr_{XY}1-Vt_{YX}$, and the wall voltage $Vw_{AY}$ between A and Y electrodes is $Vr_{AY}1-Vt_{YA}$.

As explained above, it is understood that if both the microdischarge between X and Y electrodes and the microdischarge between A and Y electrodes are generated by the first ramp voltage, the wall voltage at the end of the application of the first ramp voltage becomes a predetermined value. This phenomenon in which discharges are generated in two interelectrode positions (i.e., two interelectrode spacings) at the same time by an application of a voltage having a ramp waveform is referred to as a "simultaneous discharge."

The second ramp voltage is applied following the application of the first ramp voltage. The cell voltage between X and Y electrodes reaches the discharge starting threshold value $Vt_{XY}$ at the time point C in the figure. From the time point C to the end of the application of the second ramp voltage, the cell voltage between X and Y electrodes is maintained at the voltage $Vt_{XY}$. The XY discharge is ascendant for some period from the time point C. In this period wall voltage $Vw_{XY}$ between X and Y electrodes changes mainly. The wall voltage $Vw_{AY}$ between A and Y electrodes also changes a little. While the applied voltages $Vi_{XY}$, $Vi_{AY}$ are increased after the time point C (the polarity is positive in the figure), the cell voltage between A and Y electrodes increases though the cell voltage between X and Y electrodes is maintained at the voltage $Vt_{YX}$. At the time point D in the figure, the cell voltage between A and Y electrodes reaches the discharge starting threshold value $Vt_{AY}$. Then, the cell voltage between X and Y electrodes is maintained at the voltage $Vt_{XY}$, and the cell voltage between A and Y electrodes is maintained at the voltage $Vt_{AY}$. Namely, the simultaneous discharge occurs between X and Y electrodes and between A and Y electrodes. When $Vr_{XY}2$ is the final value of the second ramp voltage between X and Y electrodes, and $Vr_{AY}2$ is the final value between A and Y electrodes, the wall voltage $Vw_{XY}$ between X and Y electrodes at the end time point of the second ramp voltage is $-Vr_{XY}2+Vt_{XY}$, and the wall voltage $Vw_{AY}$ between A and Y electrodes is $-Vr_{AY}2+Vt_{AY}$. Therefore, if the occurrence of the simultaneous discharge by the second ramp voltage is secured, the wall voltage can be set to a value necessary for addressing by selecting the final value of the second ramp voltage. In the above-mentioned explanation, the simultaneous discharge can be generated both by the first ramp voltage and by the second ramp voltage. However, if the occurrence of the simultaneous discharge by the second ramp voltage is secured, the occurrence of the simultaneous discharge by the first ramp voltage is not always necessary. In addition, if the occurrence of the simultaneous discharge by the second ramp voltage is secured, the occurrence of the discharge by the first ramp voltage is not necessary.

The quality of the initialization is affected by the wall voltage at the time point of starting thereof. Conventionally, there can be a situation in which the simultaneous discharge does not occur depending on the setting of the final value Vr and the rate (gradient) of the ramp voltage. As explained above, if the simultaneous discharge does not occur, the wall voltage at the end of the initialization is not secured to be a target value.

FIG. 37 shows a first example of the applied voltage waveform that cannot generate the simultaneous discharge. It is supposed that the initialization includes plural steps of applying two or more ramp voltage sequentially, and the figure shows the waveform in one of the steps. In FIG. 37, wall voltage $Vw_{XY}$ between X and Y electrodes at the time point of the application start of the ramp voltage has the negative polarity and the wall voltage $VW_{AY}$ between A and Y electrodes has the positive polarity. Since the positive voltage is applied between X and Y electrodes, the XY discharge starts first. Thus, the wall voltage $Vw_{XY}$ changes mainly, and the wall voltage $Vw_{AY}$ between A and Y electrodes also changes a little. If the final value of the ramp voltage is too small (in the cases of $Vr_{XY}1$ and $Vr_{AY}1$), the discharge start condition is not satisfied between A and Y electrodes because of the increase of the wall voltage $Vw_{AY}$, so that the simultaneous discharge cannot occur. If the final value of the ramp voltage is increased, the simultaneous discharge occurs (in the cases of $Vr_{XY}2$ and $Vr_{AY}2$). Therefore, in this case the amplitude of the ramp wave should be set to a sufficient value. However, even if the applied voltage is set to a sufficient value, there is a condition where the simultaneous discharge cannot occur.

FIGS. 38A and 38B show a second example of the applied voltage waveform that cannot generate the simultaneous discharge. It is supposed that the display electrodes (the first and the second electrodes) have the same structure. In addition, it is supposed that the wall voltages $Vw_{XY}$ and $Vw_{AY}$ of the ramp voltage at the application start time point are zero. FIG. 38A shows waveforms of voltages that are applied to the electrodes (voltages between the ground line and each electrode). FIG. 38B shows waveforms of the voltages between the electrodes. The gradient of the ramp waveform between X and Y electrodes is twice the gradient of the ramp waveform between A and Y electrodes. The final value of the ramp voltage between X and Y electrodes is twice the final value of the ramp voltage between A and Y electrodes. Though there is a difference between the voltage conditions, the waveforms in FIGS. 38A and 38B are the same as the waveform in FIG. 36.

When the applied voltage increases, the first cell voltage between X and Y electrodes reaches the voltage $Vt_{XY}$, the wall voltage $Vw_{XY}$ changes so as to maintain the cell voltage between X and Y electrodes to the voltage $Vt_{XY}$. In the XY discharge, the wall voltage between X and Y electrodes changes mainly, and the wall voltage $Vw_{AY}$ between A and Y electrodes also changes. By the change of the wall voltage $Vw_{AY}$, the cell voltage between A and Y electrodes is always maintained to be a half value of the voltage $Vt_{XY}$. Therefore, even if the final values $Vr_{XY}$ and $Vr_{AY}$ of the ramp voltages are increased, the discharge start condition between A and Y electrodes is never satisfied, so that the simultaneous discharge can not occur.

As explained above, the simultaneous discharge cannot occur depending on the wall voltage value before the initialization, the gradient of the ramp waveform and the final value of the ramp voltage, so that a sufficient initialization cannot be performed. As a result, the voltage margin that can secure the addressing becomes narrow.

SUMMARY OF THE INVENTION

The object of the present invention is to improve the margin of the driving voltage for a PDP.

In the present invention, the initialization operation by applying an increasing voltage such as a ramp voltage is analyzed quantitatively, and the applied voltage is set in accordance with the analysis. The quantitative analysis enables to set the optimum drive condition in accordance with the cell structure easily and rapidly compared with setting of the drive condition in accordance with a cut-and-try experiment.

First, the method of the quantitative analysis will be explained. In a cell having three electrodes that are the first electrode (X), the second electrode (Y) and the third electrode (A), the state of the discharge can be described by the cell voltage between X and Y electrodes and the cell voltage between A and Y electrodes. The cell voltage between the first electrode and the third electrode (Hereinafter, referred to as between A and X electrodes) can be described as a difference between the cell voltage between X and Y electrodes and the cell voltage between A and Y electrodes, so the state of the cell can be determined by two voltages between X and Y electrodes and between A and Y electrodes. The combination of the cell voltages for describing the state of cell includes others, i.e., the cell voltage between A and X electrodes and the cell voltage between A and Y electrodes, the cell voltage between A and X electrodes and the cell voltage between X and Y electrodes. Any set can be selected. The following explanation is about the set of the cell voltage between X and Y electrodes and the cell voltage between A and Y electrodes. In order to illustrate the state of cell, the cell voltage between X and Y electrodes and the cell voltage between A and Y electrodes are indicated on a rectangular coordinates plane (see FIG. 1). Hereinafter, the coordinates space is referred to as a "cell voltage plane." The state of cell can be described as a point on the cell voltage plane. In addition, since the cell voltage is the sum of the wall voltage Vw and the applied voltage Vi, the relationship among the applied voltage, the wall voltage and the cell voltage of three-electrode can be understood easily by using the cell voltage plane.

The point set of cell voltage points plotted on the cell voltage plane, the cell voltage enabling the microdischarge to start, is referred to as a "Vt closed curve." The Vt closed curve indicates a voltage range in which the microdischarge can occur in the cell voltage plane. The cell voltage point when the discharge is halted is always positioned inside the Vt closed curve. If each of the microdischarges among XY, AY and AX electrodes is determined by the cell voltage between the electrodes and is not affected by the other electrode, the Vt closed curve has a hexagonal shape made of six lines as shown in FIG. 2. In the figure, $Vt_{XY}$ is the threshold value of the cell voltage at which the microdischarge start between X and Y electrodes where the second electrode (Y) is a cathode. $Vt_{YX}$ is the threshold value of the cell voltage at which the microdischarge start between X and Y electrodes where the second electrode is an anode. $Vt_{AX}$ is the threshold value of the cell voltage at which the microdischarge start between X and A electrodes where the first electrode (X) is a cathode. $Vt_{XA}$ is the threshold value of the cell voltage at which the microdischarges start between X and A electrodes where the first electrode is an anode. $Vt_{AY}$ is the threshold value of the cell voltage at which the microdischarges start between A and Y electrodes where the second electrode is a cathode. $Vt_{YA}$ is the threshold value of the cell voltage at which the microdischarges start between A and Y electrodes where the second electrode is an anode. Hereinafter, the same references are used for each threshold value of the discharge start voltage. FIG. 3 shows the Vt closed curve in accordance with a real measurement. In FIG. 3, XY discharge is affected by the third electrode and the Vt closed curve is distorted. However, in the following explanation, the Vt closed curve is regarded as a hexagon so as to deal the characteristics of the cell.

Each of the six sides AB, BC, CD, DE, EF and FA of the Vt closed curve shown in FIG. 2 corresponds to a discharge between the electrodes as below.

The side AB corresponds to the AY discharge in which the second electrode is a cathode.

The side BC corresponds to the AX discharge in which the first electrode is a cathode (the discharge between A and X electrodes).

The side CD corresponds to the XY discharge in which the first electrode is a cathode.

The side DE corresponds to the AY discharge in which the third electrode is a cathode.

The side EF corresponds to the AX discharge in which the third electrode is a cathode.

The side FA corresponds to the XY discharge in which the second electrode is a cathode.

In addition, each of the six vertexes A, B, C, D, E and F corresponds to the simultaneous discharge of the following combination.

The vertex A corresponds to the simultaneous discharge in which the second electrode is a common cathode, i.e., between X and Y electrodes and between A and Y electrodes.

The vertex B corresponds to the simultaneous discharge in which the third electrode is a common anode, i.e., between A and Y electrodes and between A and X electrodes.

The vertex C corresponds to the simultaneous discharge in which the first electrode is a common cathode, i.e., between A and X electrodes and between X and Y electrodes.

The vertex D corresponds to the simultaneous discharge in which the second electrode is a common anode, i.e., between X and Y electrodes and between A and Y electrodes.

The vertex E corresponds to the simultaneous discharge in which the third electrode is a common cathode, i.e., between A and Y electrodes and between A and X electrodes.

The vertex F corresponds to the simultaneous discharge in which the first electrode is a common anode, i.e., between X and A electrodes and between X and Y electrodes.

Using the above-mentioned concept, the operation of a cell to which the increasing voltage is applied will be explained.

FIG. 4A shows waveforms of the ramp voltages that are applied between X and Y electrodes and between A and Y electrodes, and the wall voltage. $Vr_{XY}$ and $Vr_{AY}$ are final values of the ramp voltages that are applied between X and Y electrodes and between A and Y electrodes, respectively. At the time point H in the figure, the XY discharge occurs, and after that the cell voltage between X and Y electrodes is maintained to be the voltage $Vt_{XY}$ until the application of the ramp voltage is finished. In the charge movement after the time point H, the wall voltage $Vw_{XY}$ between X and Y electrodes changes mainly since the discharge between X and Y electrodes is ascendant. When the applied voltage increases the cell voltage between X and Y electrodes is maintained to be the voltage $Vt_{XY}$, while the cell voltage between A and Y electrodes increases. Since the wall voltage $Vw_{AY}$ between A and Y electrodes also changes a little, the change rate of the cell voltage between A and Y electrodes is a little different from that of the applied voltage.

Referring to FIG. 4B, the process of this change will be explained. It is supposed that the initial wall voltage before the ramp voltage is applied is at the point G. The operation of applying the ramp voltage corresponds to increasing the voltage from the point G toward the point I. The vector GI is ($Vr_{XY}$, $Vr_{AY}$). The cell voltage during the period of applying the ramp voltage increases along the applied voltage vector inside the Vt closed curve. After colliding the Vt closed curve at the point H, it moves along the Vt closed curve toward the simultaneous discharge point A. In the figure, since it moves in the portion corresponding to the X and Y microdischarges on the Vt closed curve (the side AF), the cell voltage between X and Y electrodes is maintained to be the voltage $Vt_{XY}$, and the cell voltage between A and Y electrodes increases. The distance on the cell voltage plane, which the cell voltage after colliding the Vt closed curve moved along the Vt closed curve, corresponds to the light emission quantity when the ramp voltage is applied. Namely, the greater the distance of the movement along the Vt closed curve is, the more the light emission quantity is. The smaller the distance of the movement, the little the light emission quantity is.

When the cell voltage moves on the Vt closed curve, since the discharge is generated between X and Y electrodes, the alternation of the wall voltage (the line IJ) is large between X and Y electrodes. However, the wall voltage changes also between A and Y electrodes. The horizontal component of the vector IJ is greater than the vertical component in the figure. The ratio of the wall voltage between X and Y electrodes that changes during the X and Y microdischarges period and the wall voltage between A and Y electrodes (tan θ in the figure) is substantially a constant value. It is because the charge movement between X and Y electrodes is ascendant during the X and Y microdischarges period, and there is little charge flowing in the third electrode. The ratio is $1/(1+Cw_Y/Cw_X)$ considering an equivalent circuit model of the PDP as shown in FIG. 5.

Therefore, it is necessary for the wall voltage point being directed to the simultaneous discharge point A after the X and Y microdischarges have started that the ratio of the applied voltage between X and Y electrodes and the applied voltage between A and Y electrodes (the gradient of the line indicating the direction of the applied voltage vector) is greater than the ratio of the wall voltage between X and Y electrodes that changes during the X and Y microdischarges period and the wall voltage between A and Y electrodes (hereinafter, referred to as a writing ratio). FIG. 6 shows a locus of the cell voltage in the case where the gradient of the line indicating the direction of the applied voltage vector is greater than the writing ratio (applied voltage vector 1), and that in the case where the former is smaller than the latter (applied voltage vector 2). In the applied voltage vector 1, the cell voltage moves toward the simultaneous discharge point A of the XY discharge and the AY discharge. In contrast, in the applied voltage vector 2, the cell voltage moves toward the simultaneous discharge point F of the XY discharge and the XA discharge.

In the same way, during the AY microdischarge period, the charge movement between A and Y electrodes is ascendant, and there is little charge flowing in the first electrode. Therefore, the writing ratio in this period is substantially a constant value, too. The ratio is $1+Cw_Y/Cw_A$ considering the equivalent circuit model shown in FIG. 5. In the same way, the charge movement between A and X electrodes is ascendant during the AX microdischarge period, and there is little charge flowing in the third electrode. Therefore, the writing ratio in this period is substantially a constant value, too. The ratio is $-Cw_X/Cw_A$ considering the equivalent circuit model shown in FIG. 5.

As explained above, the adjustment process of the wall voltage in the microdischarge can be analyzed by using the Vt closed curve on the cell voltage plane. Next, the method for generating the simultaneous discharge of the present invention securely will be explained.

Referring to FIG. 7, the gradient of the applied voltage vector on the cell voltage plane is tan ψ. In addition, the gradient of the wall voltage vector determined by the writing ratio when the XY discharge is generated is tan θ XY, and the gradient of the wall voltage vector determined by the writing ratio when the AY discharge is generated is $\tan \theta_{AY}$. It is supposed that the cell voltage is to be moved to the simultaneous discharge point A of the XY discharge and the AY discharge by using the applied voltage vector having the gradient tan ψ. It is necessary for moving to the simultaneous discharge point A by the applied voltage vector that satisfies that following condition.

$$\tan \theta_{AY} > \tan \psi > \tan \theta_{XY}$$

Therefore, in order to generate the simultaneous discharges between X and Y electrodes and between A and Y electrodes, the waveform of the applied voltage should be set so as to satisfy the condition. The waveform is not limited to the triangular waveform, and can be a waveform of a ramp voltage shown in FIG. 8 plus an offset voltage. Since the discharge does not occur even if the cell voltage is moved inside the Vt closed curve, the microdischarge is generated by the ramp voltage after changing the cell voltage largely by the offset. In this case too, the amplitude of the ramp voltage is set to a value so that the cell voltage is directed to the simultaneous discharge. Namely, It is necessary that $V_{XY}2$ and $V_{AY}2$ in the figure should satisfy the condition for moving to the simultaneous discharge point. Adding of the offset voltage can shorten the time of initialization compared with the case where the applied voltage is increased gradually from zero volts. In addition, the adding of the offset voltage is also effective for reducing the light emission quantity in the initialization step by shortening the distance of movement along the Vt closed curve.

The real initialization is divided into plural steps, and an increasing voltage that is adjusted correctly in accordance with the Vt closed curve is applied in each step. It is effective for setting the voltage for the initialization to utilize a shape of the Vt closed curve. In this method, as shown in FIG. 9, a line is drawn that passes the simultaneous discharge point and is parallel to the side having an end of the other simultaneous discharge point (a discharge threshold value line). In the figure, a line passing the point A and is parallel to the side BC is drawn by the broken line. The wall voltage on this line starts the two discharges between the electrodes simultaneously when the voltage vector having the same direction as the line is applied. The process in which one of the discharges between electrodes occurs first, and then another simultaneous discharge occurs is not adopted. The six applied voltage vectors having such characteristics are illustrated by arrows. Since the applied voltage vector satisfies the condition for moving the cell voltage to the simultaneous discharge point, the simultaneous discharge can be generated even if the wall voltage becomes off the line.

The principle of the initialization according to the present invention will be explained with reference to FIGS. 10A–10C. There is a difference of the charge state between the cell that was lighted in the previous display period and the cell that was not lighted at the starting time point of the initialization. It is supposed that the wall voltages before the ramp voltage is applied (i.e., the cell voltages when the applied voltage is zero) are at the positions of the cell 1 and the cell 2 that are shown by open round marks in FIG. 10A.

[1] The voltage of the value $Vt_{XY}-Vt_{AY}+Vt_{AX}$ that is calculated in accordance with the Vt closed curve is applied between X and A electrodes of these cells so that the third electrode becomes the anode. This application of the voltage can be realized by applying the ramp voltage having the amplitude shown in FIG. 10B between X and Y electrodes and between A and Y electrodes. For example, the potential of each electrode is controlled as shown in FIG. 10C. The application of the voltage causes the XA discharge, and each of the wall voltages of the two states moves to the black point on the line AO shown in FIG. 10A. Namely, the first ramp voltage aligns the wall voltages on the line AO.

[2] Next, the second ramp voltages having the same amplitude are applied between X and Y electrodes and between A and Y electrodes. Since the wall voltage is aligned on the line AO by the first ramp voltage, the second ramp voltage causes the XY discharge and the discharge between A and Y electrodes simultaneously.

In the example of FIGS. 10A–10C, the amplitude of the first ramp voltage is set to the value $-(Vt_{XY}-Vt_{AY}+Vt_{AX})/2$ between X and Y electrodes and to the value $(Vt_{XY}-Vt_{AY}+Vt_{AX})/2$ between A and Y electrodes. However, the applied voltage between A and X electrodes is $Vt_{XY}-Vt_{AY}+Vt_{AX}$, and it is enough that the XA discharge occurs by first ramp voltage. FIG. 11 shows another example in which the applied voltage between A and X electrodes is $Vt_{XY}-Vt_{AY}+Vt_{AX}$, and the voltages between X and Y electrodes and between A and Y electrodes are different from the example of FIGS. 10A–10C.

Even if the cell structure has a variation, or if an error of the linear approximation of the Vt closed curve from the real measurement value is relatively large, or if the wall voltage becomes off the line including the simultaneous discharge point due to the first ramp voltage, since the direction of the applied voltage vector is set to be directed to the simultaneous discharge point, the occurrence of the simultaneous discharge can make the wall voltage the target value that is suitable for the addressing. Without an accurate calculation of the applied voltage, the sufficient initialization can be performed securely by setting the direction of the applied voltage vector appropriately.

A method according to a first aspect of the present invention is for setting an applied voltage in a plasma display panel having discharge cells with at least three electrodes whose potentials can be controlled independently. The method comprises the steps of determining a range of voltage that can generate a charge adjustment discharge for setting a wall charge quantity in a coordinates space that indicates the relationship between an effective voltage between first electrodes and an effective voltage between second electrodes, and determining a waveform of the increasing voltage that is applied to the discharge cell for generating the charge adjustment discharge in accordance with the voltage range.

According to a second aspect of the present invention, the waveform of the increasing voltage is determined in accordance with the voltage range so that the light emission quantity of the charge adjustment discharge is minimized.

A method according to a third aspect of the present invention is for driving a plasma display panel having discharge cells with at least three electrodes whose potentials can be controlled independently. In this method, a charge adjustment discharge for changing a wall charge quantity is generated simultaneously in at least two interelectrode spacings of each discharge cell as a preparation process of the addressing.

According to a fourth aspect of the present invention, the charge adjustment discharge is generated between first electrodes as well as between second electrodes, and after that the charge adjustment discharge is generated between first electrodes as well as between third electrodes in each discharge cell as the preparation process of the addressing.

According to a fifth aspect of the present invention, a change of the voltage that is applied for generating the charge adjustment discharge both between the first electrodes and between the second electrodes is substantially the same as a change of the voltage that is applied for generating the charge adjustment discharge both between the first electrodes and between the third electrodes.

According to a sixth aspect of the present invention, the charge adjustment discharge is generated by applying a voltage increasing at a constant rate.

According to a seventh aspect of the present invention, the charge adjustment discharge is generated by applying a voltage having an obtuse waveform whose change rate decreases gradually.

According to an eighth aspect of the present invention, the charge adjustment discharge is generated by applying a voltage having a step waveform increasing step by step.

According to a ninth aspect of the present invention, the charge adjustment discharge is generated by applying a voltage having a waveform whose change rate is larger in a period while the effective voltage between the electrodes that is the application target does not exceed a discharge start voltage than in a period while the effective voltage exceeds the discharge start voltage.

According to a tenth aspect of the present invention, the charge adjustment discharge is generated by applying a voltage having a waveform that increases step by step in a period while the effective voltage between the electrodes that is the application target does not exceed a discharge start voltage and increases gradually in a period while the effective voltage exceeds the discharge start voltage.

According to an eleventh aspect of the present invention, the preparation process includes plural steps having different voltage applications among three electrodes.

According to a twelfth aspect of the present invention, the display is a gradation display in which a field of display information includes plural subfields having weighted luminance, and each of the plural subfields includes two subfields performing the preparation processes having different contents.

According to a thirteenth aspect of the present invention, the field has plural subfields including a subfield performing the preparation process including three steps and a subfield performing the preparation process including two steps.

According to a fourteenth aspect of the present invention, the preparation process including three steps is performed in the subfield having the largest weight of luminance.

A display device according to a fifteenth aspect of the present invention comprises a plasma display panel having a screen formed by discharge cells with at least three electrodes whose potentials can be controlled independently, and a drive circuit for generating charge adjustment discharges simultaneously that change a wall charge quantity in at least two interelectrode spacings of each discharge cell as a preparation process of the addressing without changing a polarity of the charging in the at least two interelectrode spacings.

BRIEF DESCRIPTION OF THE DRAWINGS

FIG. 8 shows the relationship between a direction of an applied voltage vector and a cell voltage change.

FIG. 37 shows a first example of the applied voltage waveform that cannot generate the simultaneous discharge.

DESCRIPTION OF THE PREFERRED EMBODIMENTS

Hereinafter, the present invention will be explained in detail with reference to embodiments and accompanied drawings.

Figure 1:
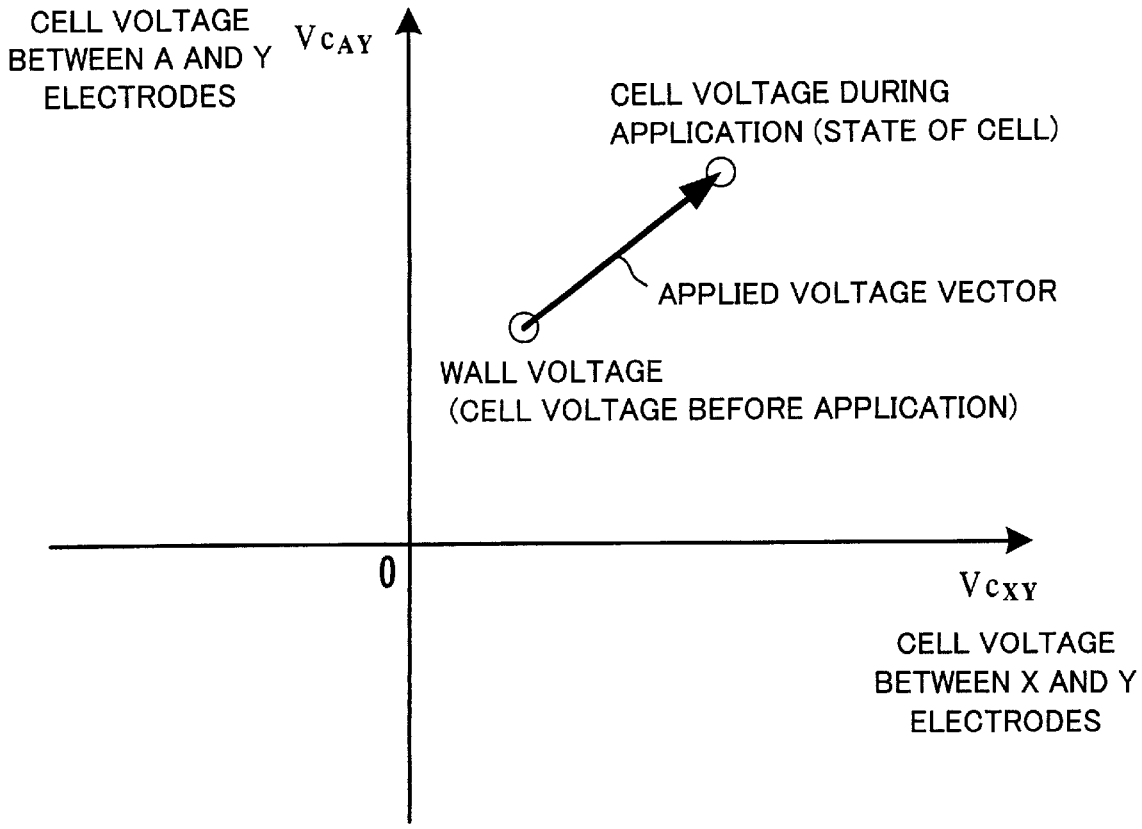
FIG. 1 shows a cell voltage plane.
Figure 2:
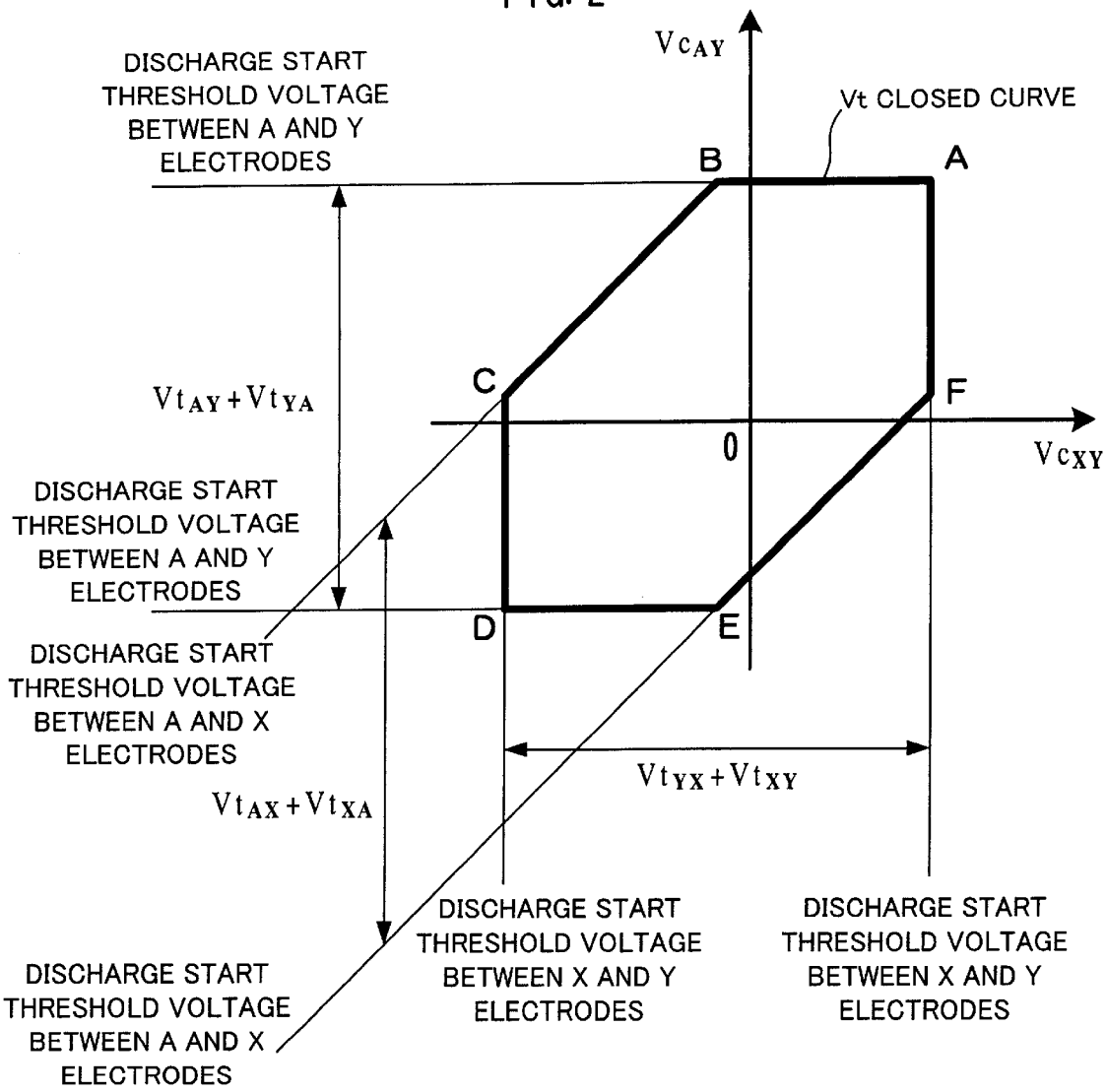
FIG. 2 is an explanatory diagram of a Vt closed curve.
Figure 3:
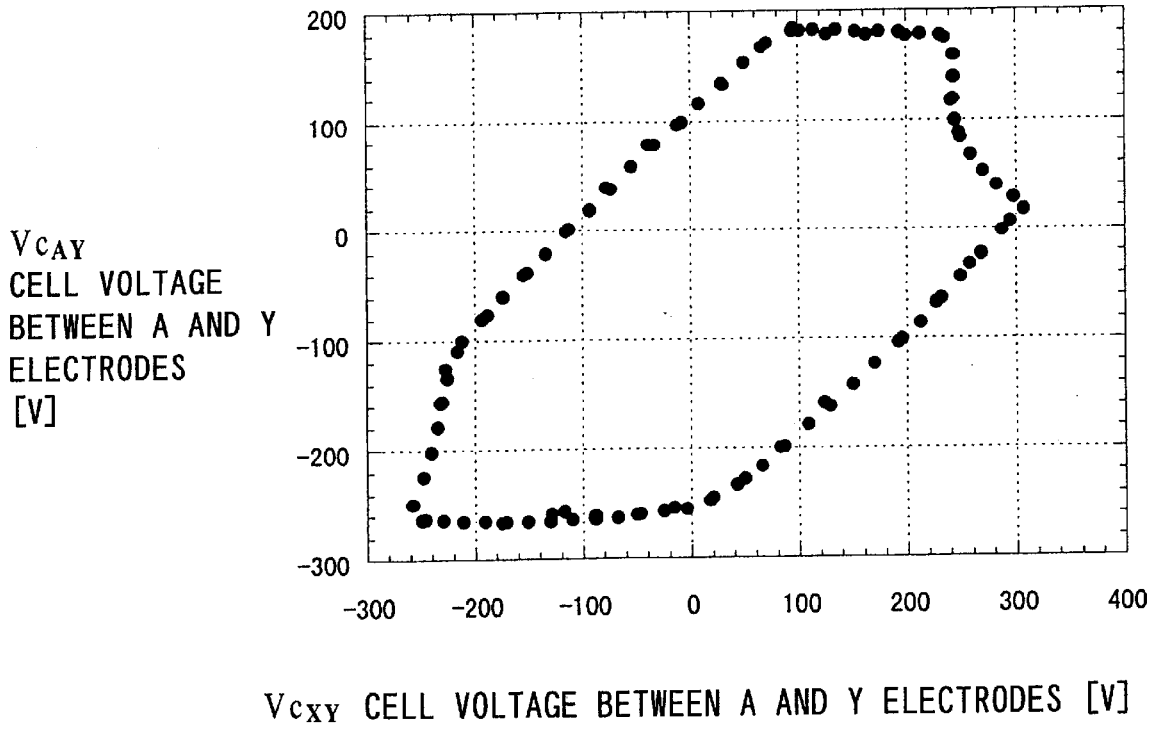
FIG. 3 shows the real measurement example of the Vt closed curve.
Figure 4A:
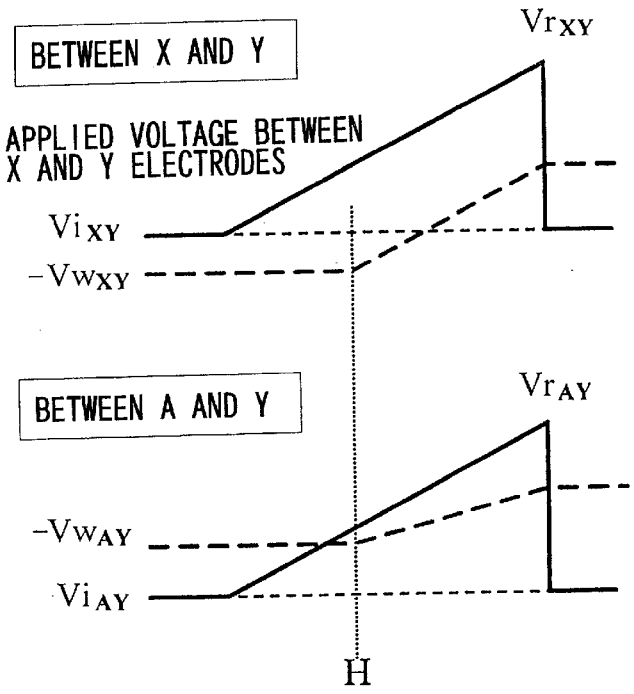
FIGS. 4A and 4B are explanatory diagrams of the operation of the cell.
Figure 4B:
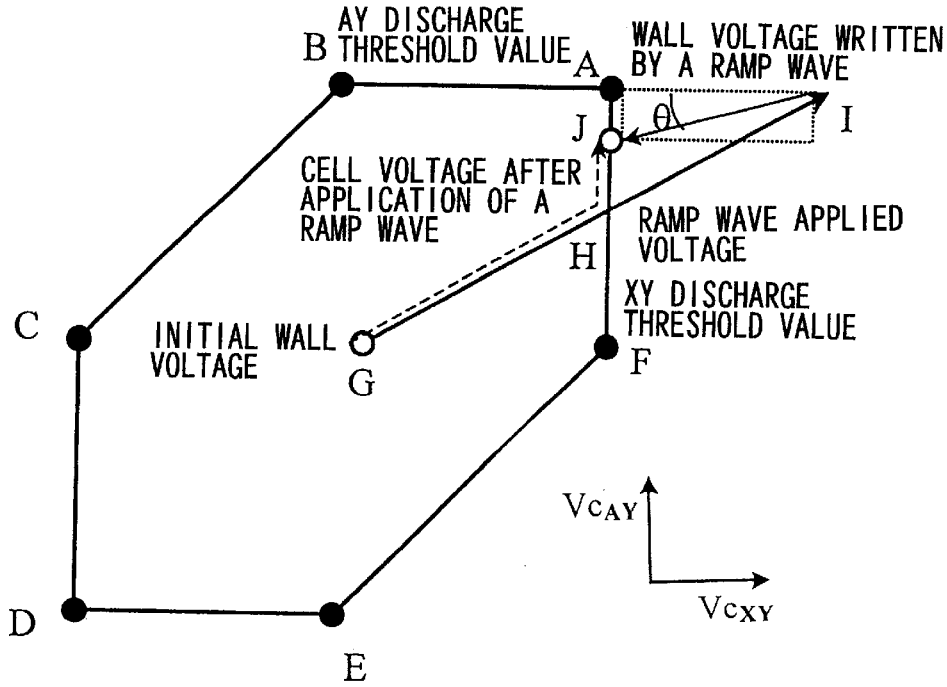
Figure 5:
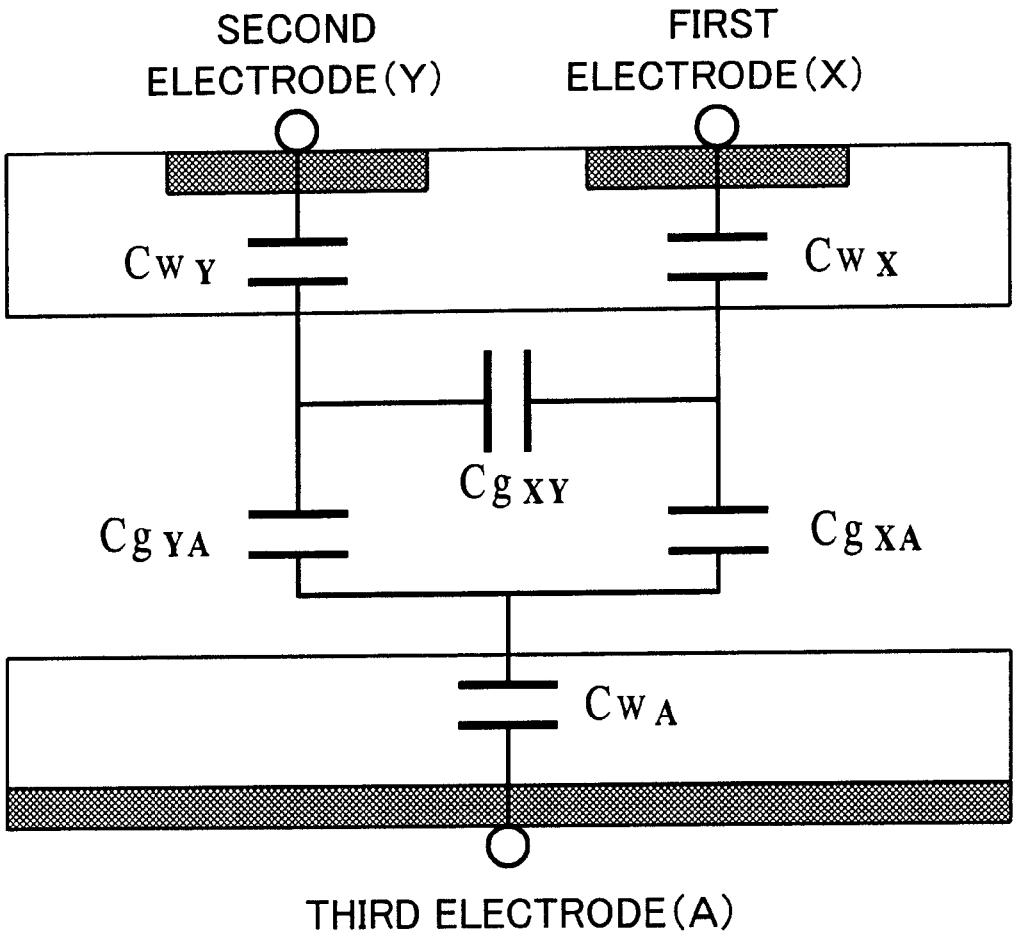
FIG. 5 shows an equivalent circuit model of a cell having a three-electrode structure.
Figure 6:
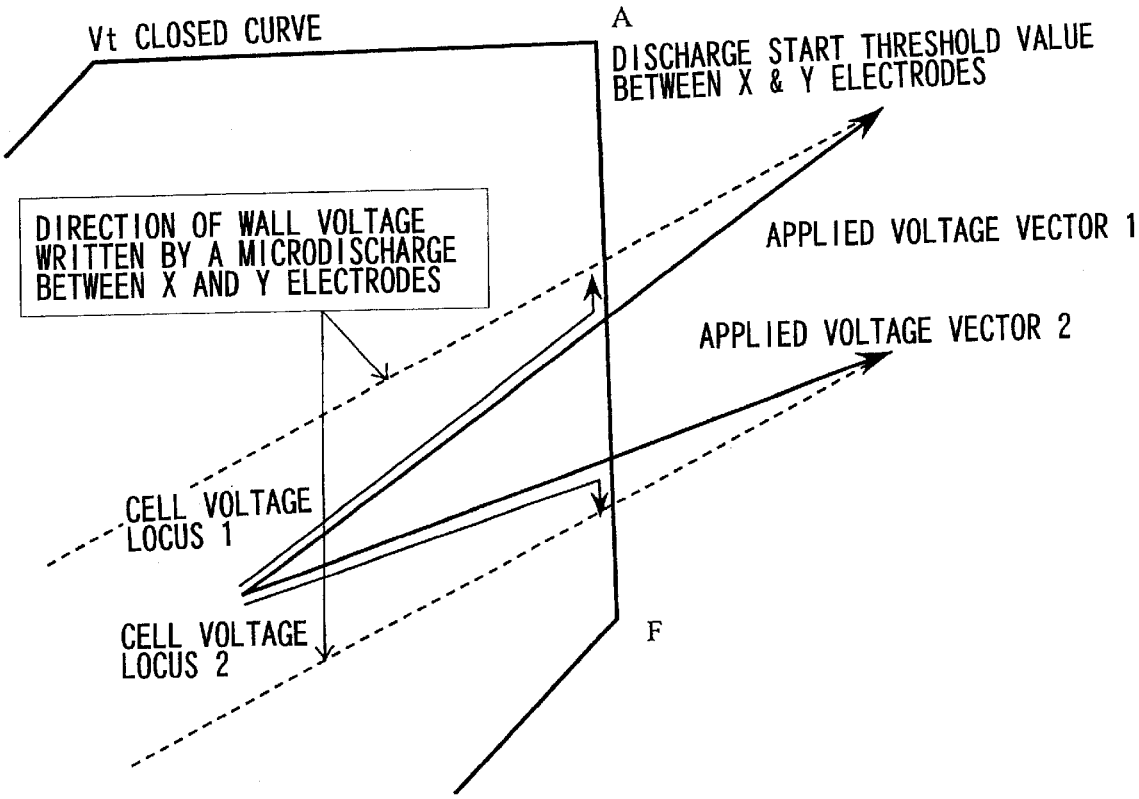
FIG. 6 shows the relationship between a direction of an applied voltage vector and a cell voltage change.
Figure 7:
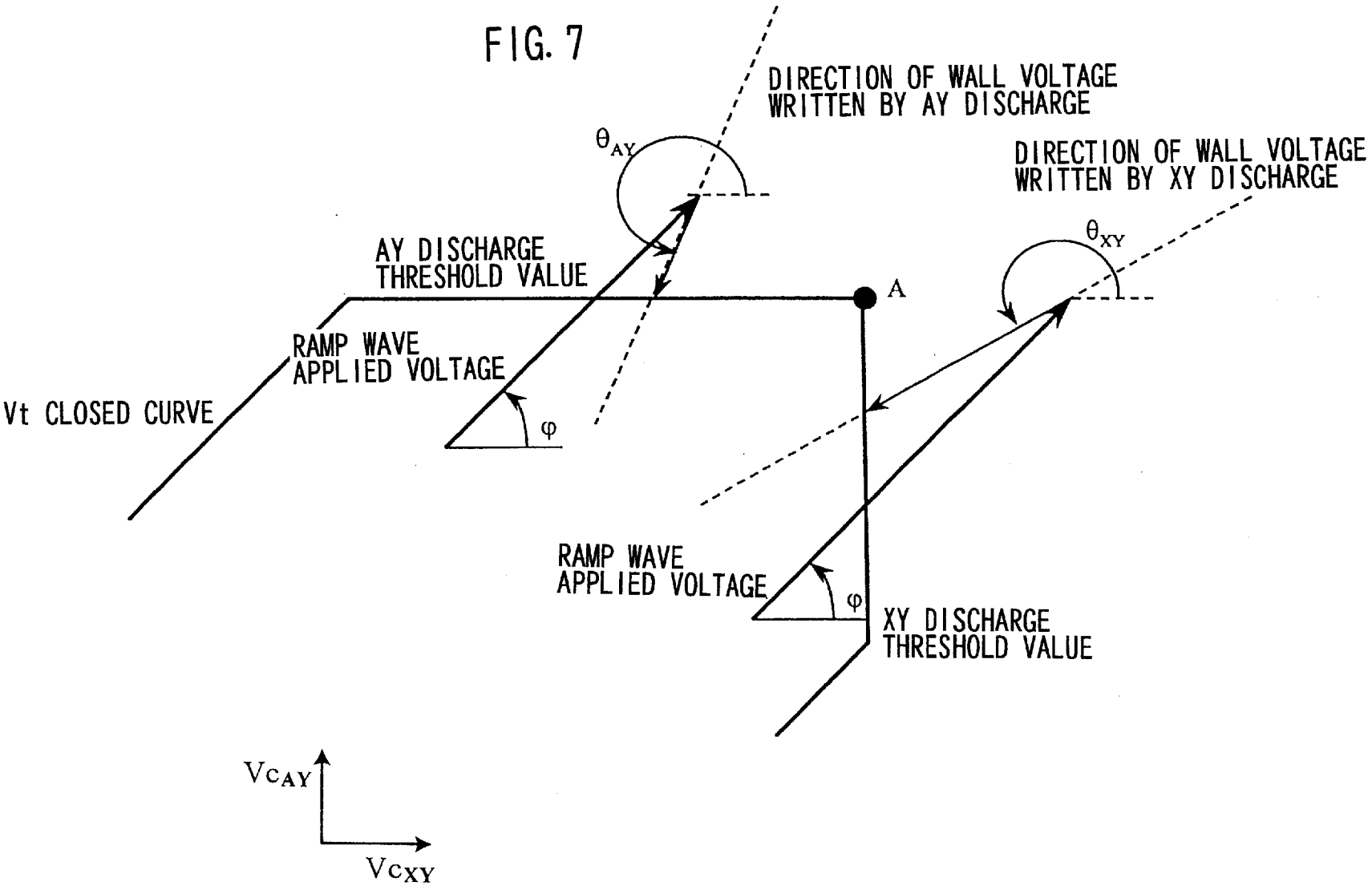
FIG. 7 shows the relationship between a direction of an applied voltage vector and a cell voltage change.
Figure 9:
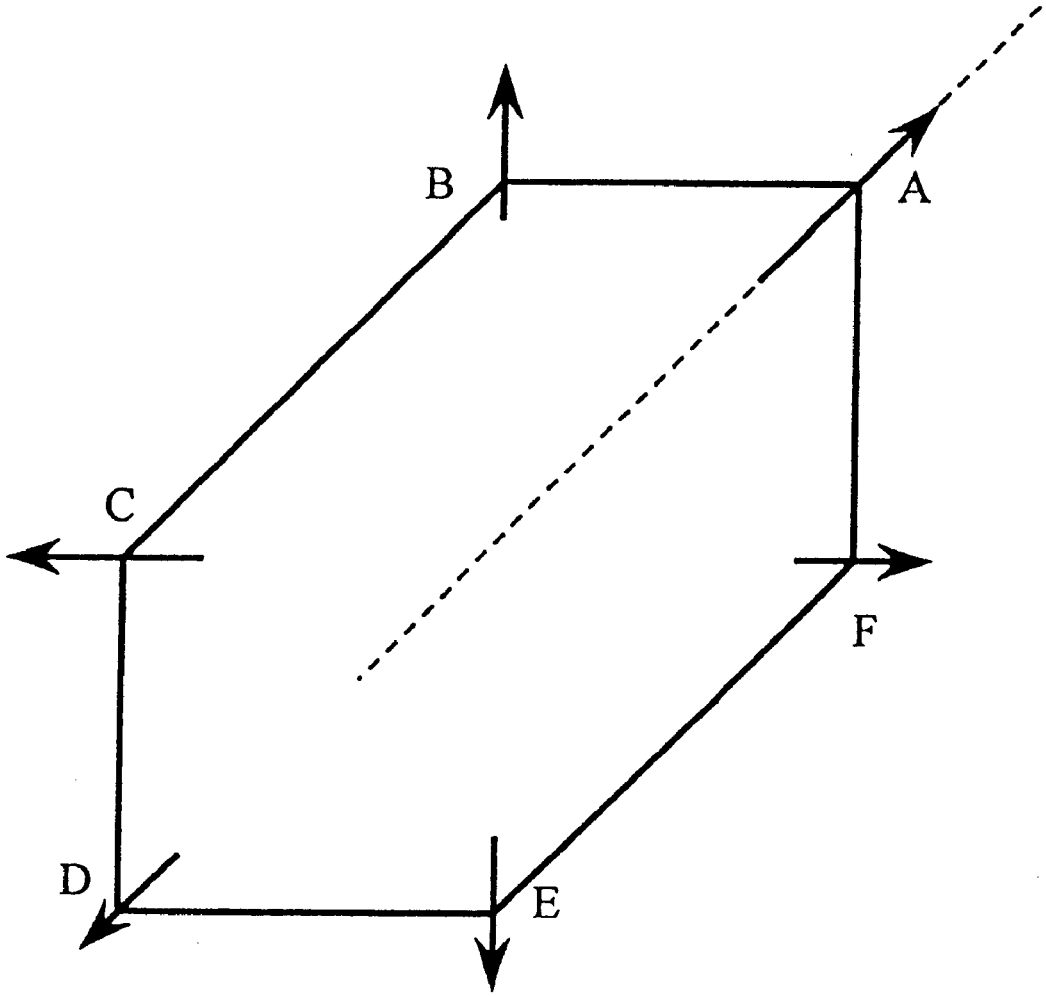
FIG. 9 is a diagram for explaining a process of voltage setting according to the present invention.
Figure 10A:
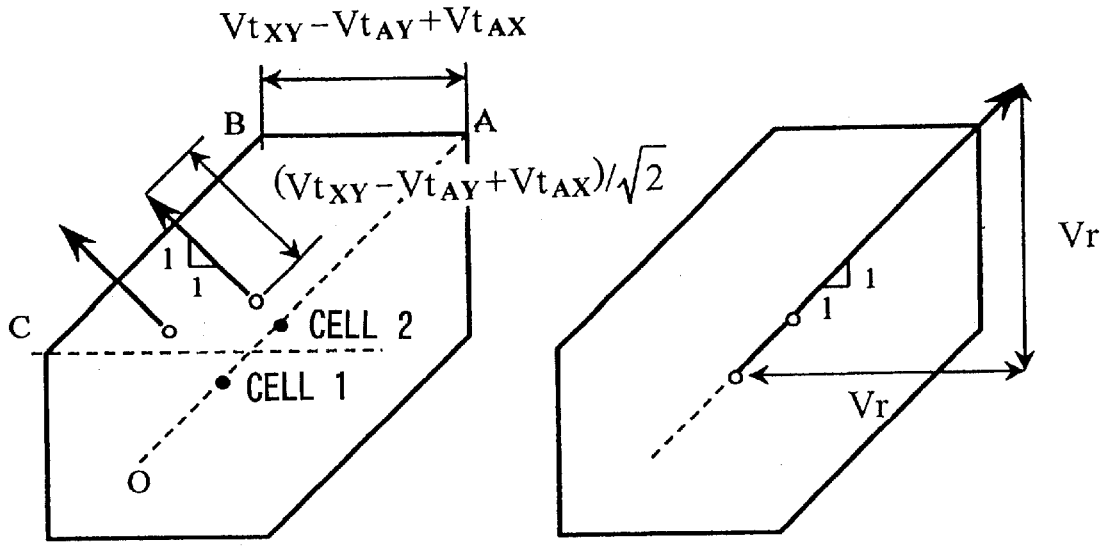
FIGS. 10A–10C show a first example of the initialization according to present invention.
Figure 10B:
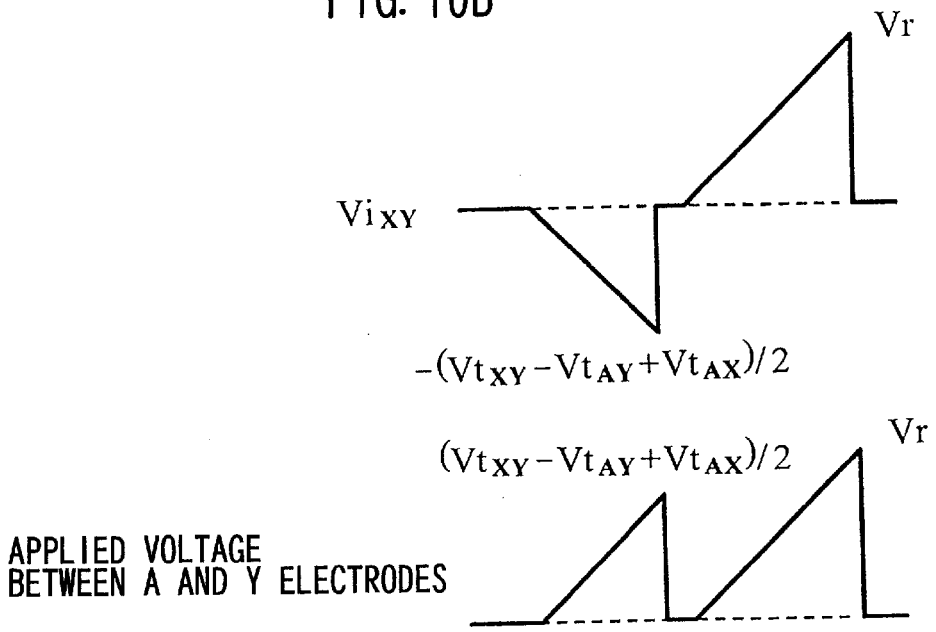
Figure 10C:
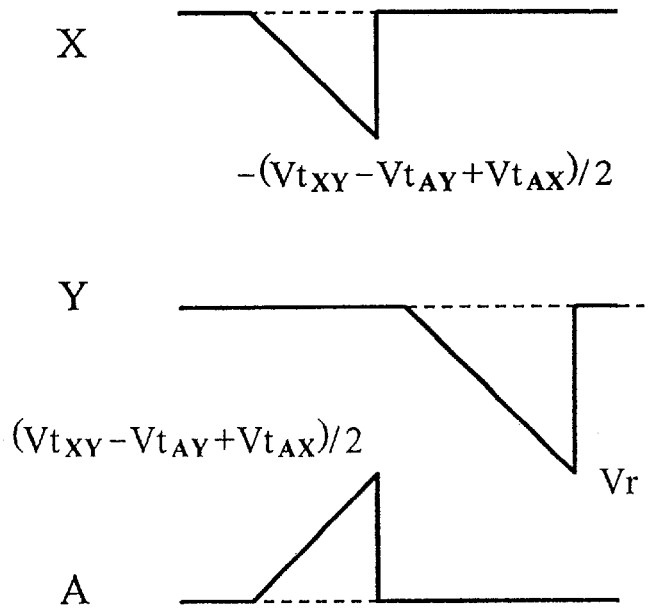
Figure 11:
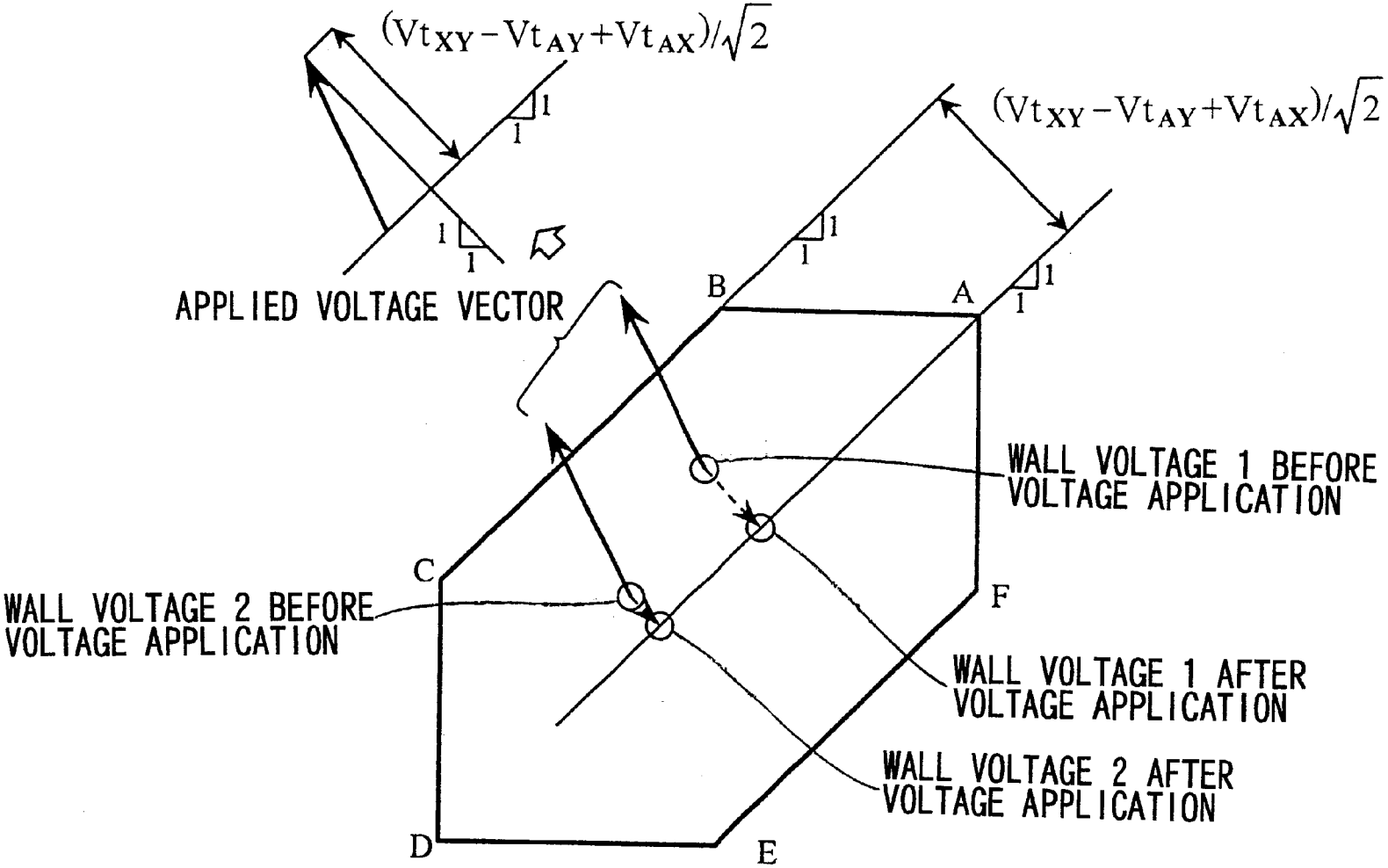
FIG. 11 shows a second example of the initialization according to present invention.
Figure 12:
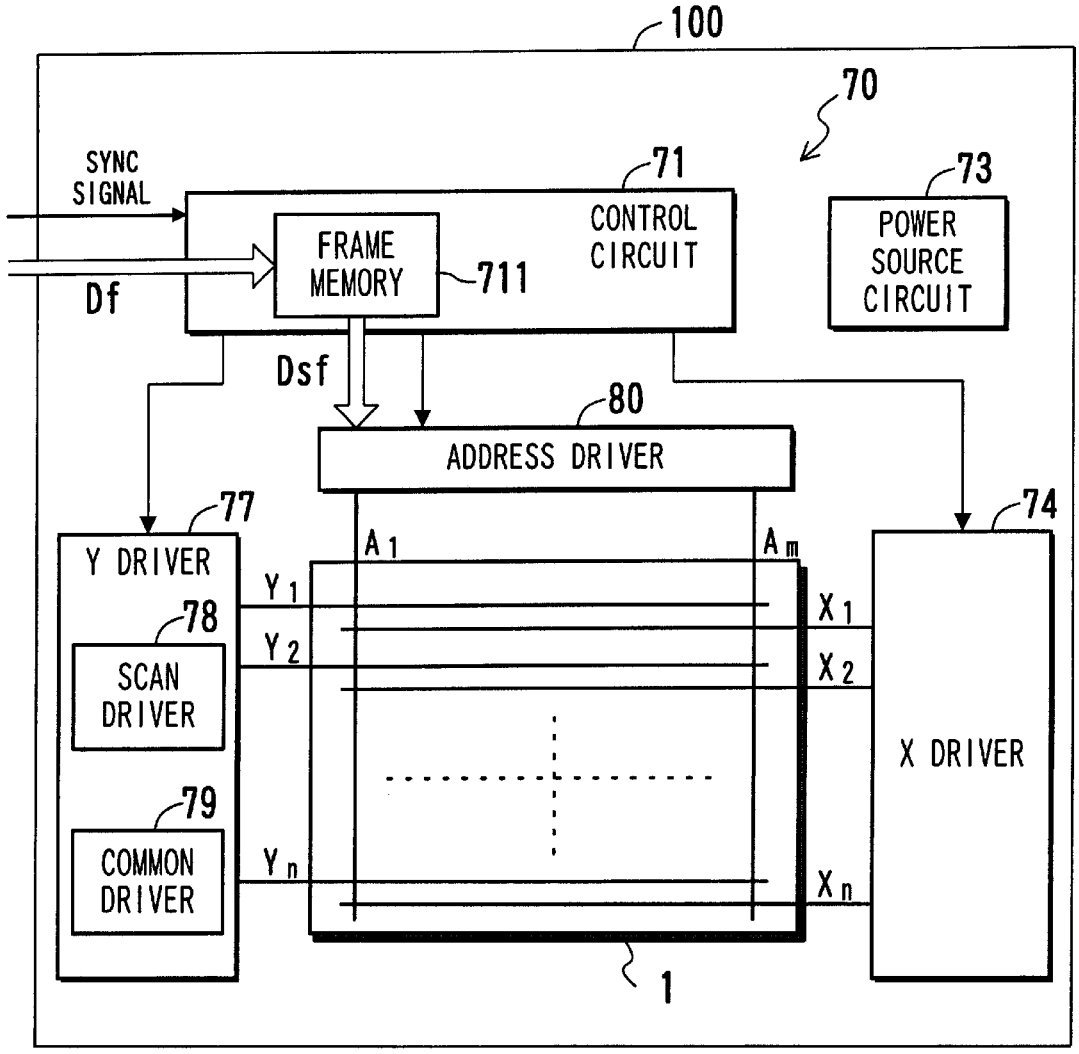
FIG. 12 shows a structure of a display device according to the present invention.

FIG. 12 shows a structure of a display device according to the present invention. The display device 100 includes a surface discharge type PDP 1 having a screen of m columns and n rows and a drive unit 70 for selectively lighting discharge cells arranged in a matrix. The display device 100 can be used for a wall-hung television set or a monitor display of a computer system.

The PDP 1 has a first and a second electrodes X, Y arranged in parallel for generating display discharge and a third electrode (an address electrode) A arranged so as to cross the electrodes X, Y. The electrodes X, Y extend in the row direction (the horizontal direction) of the screen. The electrode Y of them is used as a scan electrode for a row selection in addressing. The electrode A extends in the column direction (the vertical direction) and is used as a data electrode for a column selection.

The drive unit 70 includes a control circuit 71 for a drive control, a power source circuit 73, an X driver 74, a Y driver 77 and an address driver 80. Frame data Df that are the multivalue image data indicating luminance levels of red, green and blue colors are inputted in the drive unit 70 along with various synchronizing signal from external equipment such as a TV tuner or a computer. The control circuit 71 has a frame memory 711 for temporarily storing the frame data Df.

The frame data Df are stored in the frame memory 711 temporarily and then are converted into subfield data Dsf for gradation display. After that, they are transferred to the address driver 80. The subfield data Dsf are display data of q bits indicating q subframes (a set of display data of q screens of 1 bit per 1 subpixel), and the subfield is a binary image having a resolution of m×n. The value of each bit of the subfield data Dsf indicates whether the light emission of the subpixel is necessary in the corresponding subframe, more specifically indicates whether the address discharge is necessary.

The X driver 74 controls potentials of the n main electrodes X as a unit. The Y driver 77 includes a scan driver 78 and a common driver 79. The scan driver 78 is means for switching a potential for the row selection in addressing. The address driver 80 controls potentials of m electrodes A in accordance with the subfield data Dsf. These drivers are supplied with a predetermined electric power by the power source circuit 73 through wiring conductors (not shown).

Figure 13:
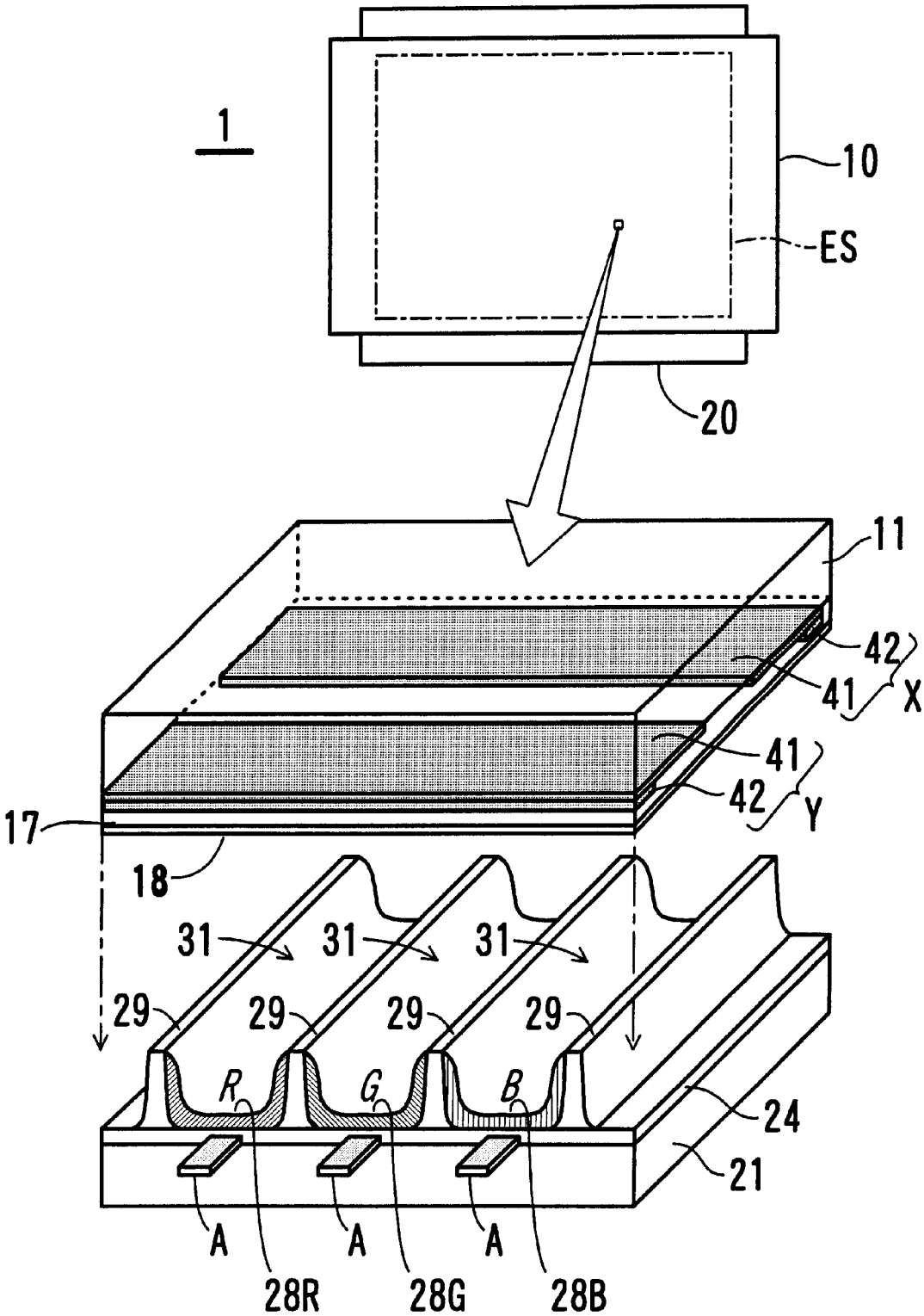
FIG. 13 shows a cell structure of a PDP according to the present invention.

FIG. 13 shows a cell structure of a PDP according to the present invention. PDP 1 comprises a pair of substrate structures (each structure has a substrate on which elements of the discharge cell are arranged) 10, 20. In each discharge cell of the screen ES, a pair of electrodes X, Y and an electrode A cross each other. The electrodes X, Y are arranged on the inner surface of a glass substrate 11 of the front substrate structure 10. Each of the electrodes X, Y includes a transparent conductive film 41 that forms a surface discharge gap and a metal film (s bus electrode) 42 that extends over the entire length of the row. A dielectric layer 17 having the thickness of 30–50 μm covers the electrodes X, Y, and the surface of the dielectric layer 17 is coated with a protection film 18 made of a magnesia (MgO).

The electrode A is arranged on the inner surface of the glass substrate 21 of the back substrate structure 20 and covered with a dielectric layer 24. On the dielectric layer 24, a banding partition 29 having the height of approximately 150 μm is arranged each between the electrodes A. The partitions 29 divide the discharge space in the row direction (the horizontal direction of the screen ES) for each column. A column space 31 of the discharge space corresponding to each column is continuous over all rows. Covering the inner surface of the back side including the upper side of the electrode A and the side surface of the partition 29, red, green and blue color fluorescent material layers 28R, 28G and 28B for color display are provided. Italic alphabet R, G and B in the figure denote light emission colors of the fluorescent materials. The fluorescent material layers 28K, 28G and 28B are excited locally by ultraviolet rays emitted by a discharge gas and emit light. A structure of a column of row defined by a pair of electrodes X, Y (the light emission color is red, green or blue) is a cell.

Figure 14:
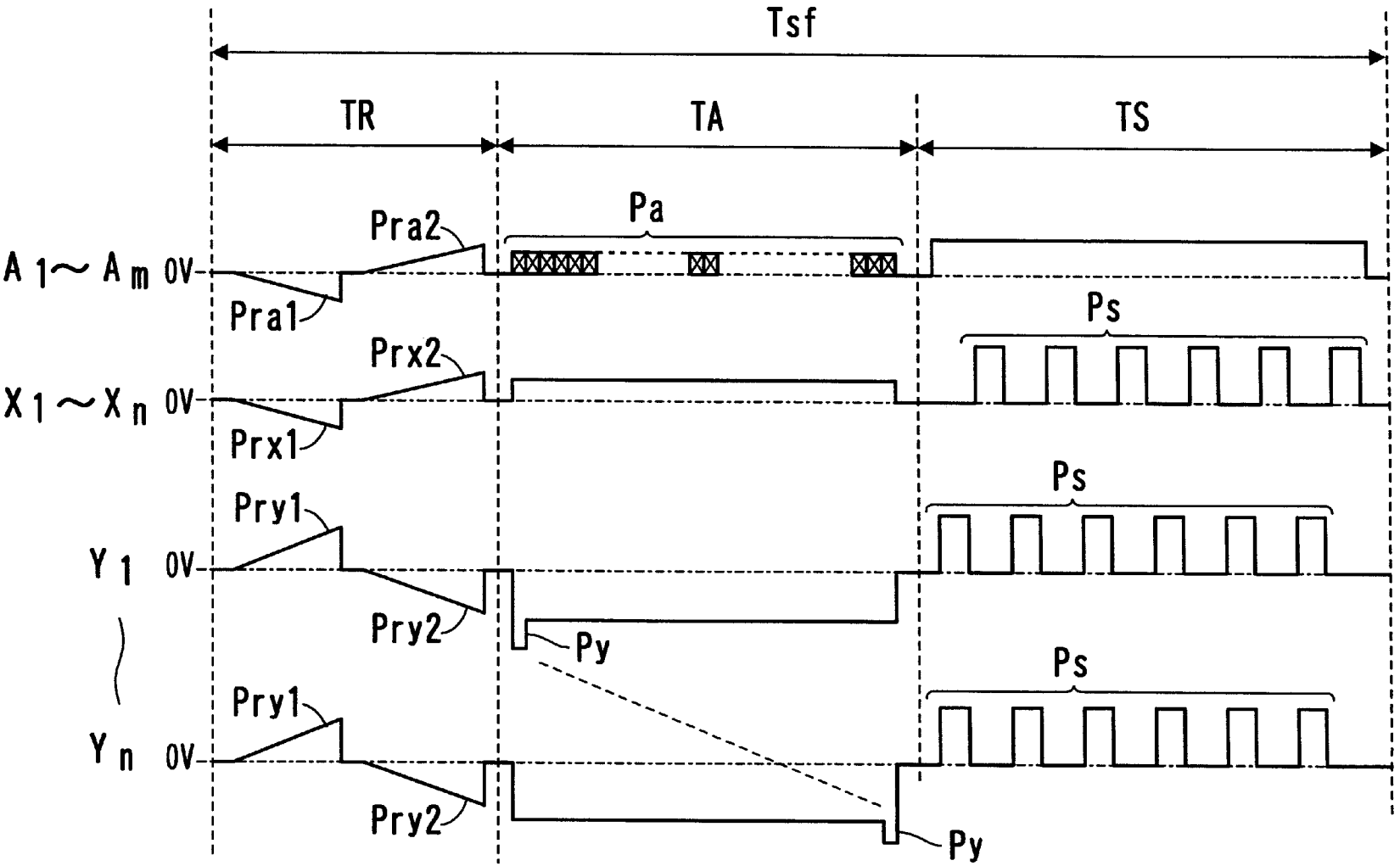
FIG. 14 shows voltage waveforms of a drive sequence.

FIG. 14 shows voltage waveforms of a drive sequence. The suffixes of the electrodes X, Y indicate the order of the row arrangement, and the suffix of the electrode A indicates the order of the corresponding column arrangement.

In order to reproduce a gradation in the display, the time sequential field is divided into a predetermined number p of subfields. The subfield period Tsf assigned to each subfield includes a preparation period TR for equalizing the distribution of charge in the screen, an address period TA for forming the distribution of charge in accordance with contents of display, and a sustaining period TS for securing a luminance corresponding to a gradation value. The length of the address period TA is constant despite the weight of the luminance, but the length of the sustaining period TS is longer for the larger weight of the luminance. The length of the preparation period TR is constant when the same initialization is performed for all subfields but is not constant when the different initialization is performed depending on the weight of the luminance.

The initialization step in the preparation period TR includes plural steps. The figure shows an example of two steps. The applied voltage vector is calculated in accordance with the Vt closed curve obtained by the real measurement of the PDP 1, and an appropriate increasing voltage (a ramp voltage in the figure) is applied between X and Y electrodes, between A and Y electrodes, and between A and X electrodes for each step. In FIG. 14, the ramp waveform pulse Pra 1 and the ramp waveform pulse Pra 2 having the opposite polarity are applied sequentially to all electrodes $A_1$–$A_m$, the ramp waveform pulse Prx 1 and the ramp waveform pulse Prx 2 having the opposite polarity are applied sequentially to all electrodes $X_1$–$X_n$, and the ramp waveform pulse Pry 1 and the ramp waveform pulse Pry 2 having the opposite polarity are applied sequentially to all electrodes $Y_1$–$Y_n$. The application of a pulse means to bias an electrode potential temporarily from a reference potential (e.g., the ground potential).

In the address period TA, the wall charge necessary for sustaining is formed in the cells to be lighted. All main electrodes $X_1$–$X_n$ and all electrodes $Y_1$–$Y_n$ are biased to a predetermined potential, and a scan pulse Py is applied to an electrode Y that corresponds to the selected row for each row selection period (a scan time of one row). At the same time of the row selection, an address pulse Pa is applied to an electrode A corresponding to cells to be lighted. Namely, in accordance with the subfield data Dsf for m columns of the selected row, the potentials of the electrodes $A_1$–$A_m$ are controlled by the binary value. In the cell to be lighted, a discharge occurs between the electrode Y and the electrode A and causes the surface discharge between X and Y electrodes. This set of sequential discharges is an address discharge.

In the sustaining period TS, a display pulse Ps having a predetermined polarity (positive polarity in the example) is applied to all main electrodes $Y_1$–$Y_n$ first. After that, the display pulse Ps is applied alternately to the electrodes $X_1$–$X_n$ and the electrodes $Y_1$–$Y_n$. In this example, the final display pulse Ps is applied to the electrodes $X_1$–$X_n$. The application of the display pulse Ps generates the surface discharge in the cells having a remaining wall charge in the address period TA. Then, the polarity of the wall voltage between the electrodes is switched by every surface discharge. In order to prevent an undesirable discharge during the sustaining period TS, the electrodes $A_1$–$A_m$ are biased to the same polarity as the display pulse Ps.

Various examples of the initialization in the preparation period TR are shown below.

Figure 15:
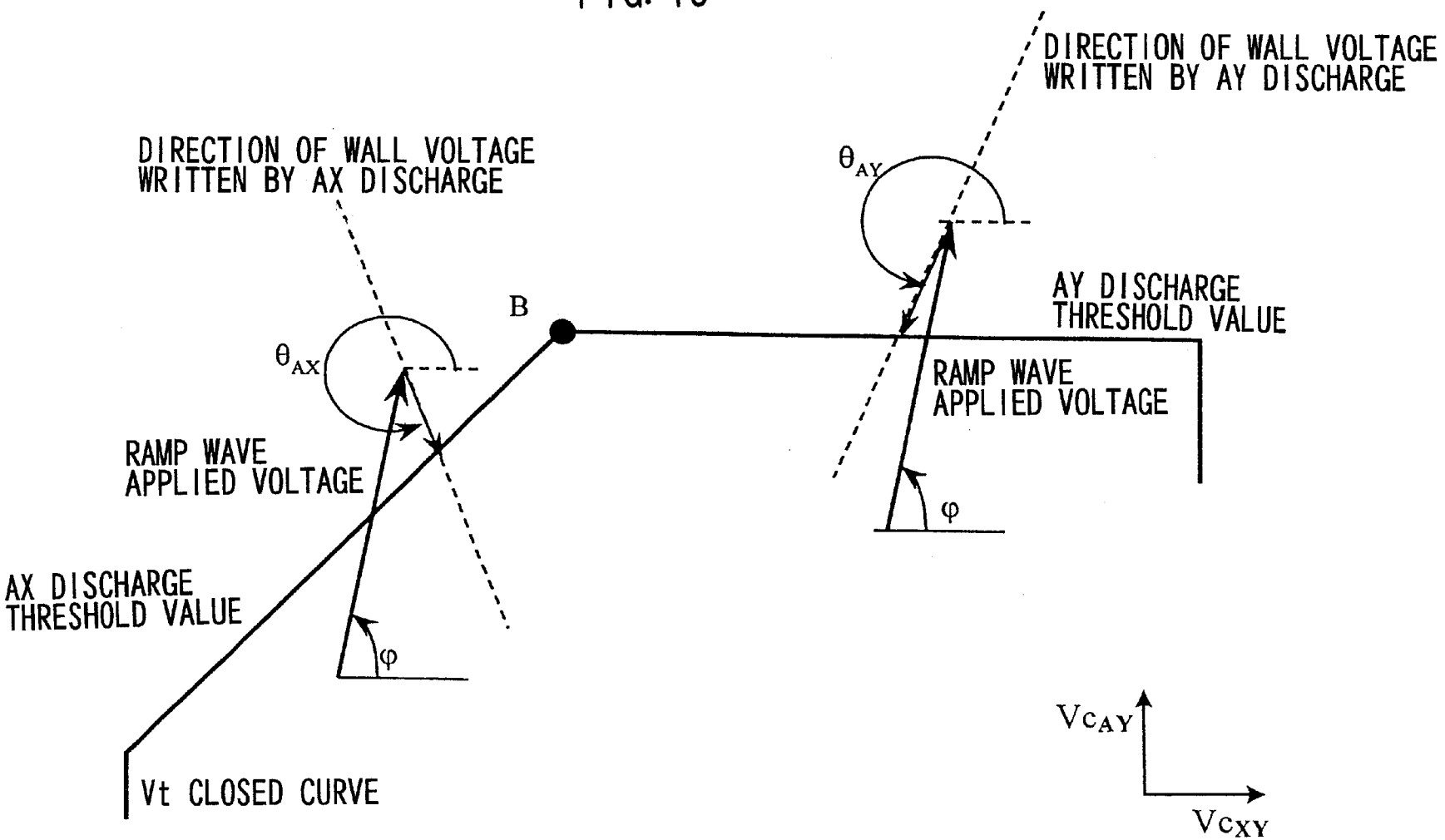
FIG. 15 shows a first example of the applied voltage vector.

The applied voltage vector in the example of FIG. 15 moves the cell voltage to the simultaneous discharge point B between A and X electrodes and between A and Y electrodes in which the electrode A is the anode.

Figure 16:
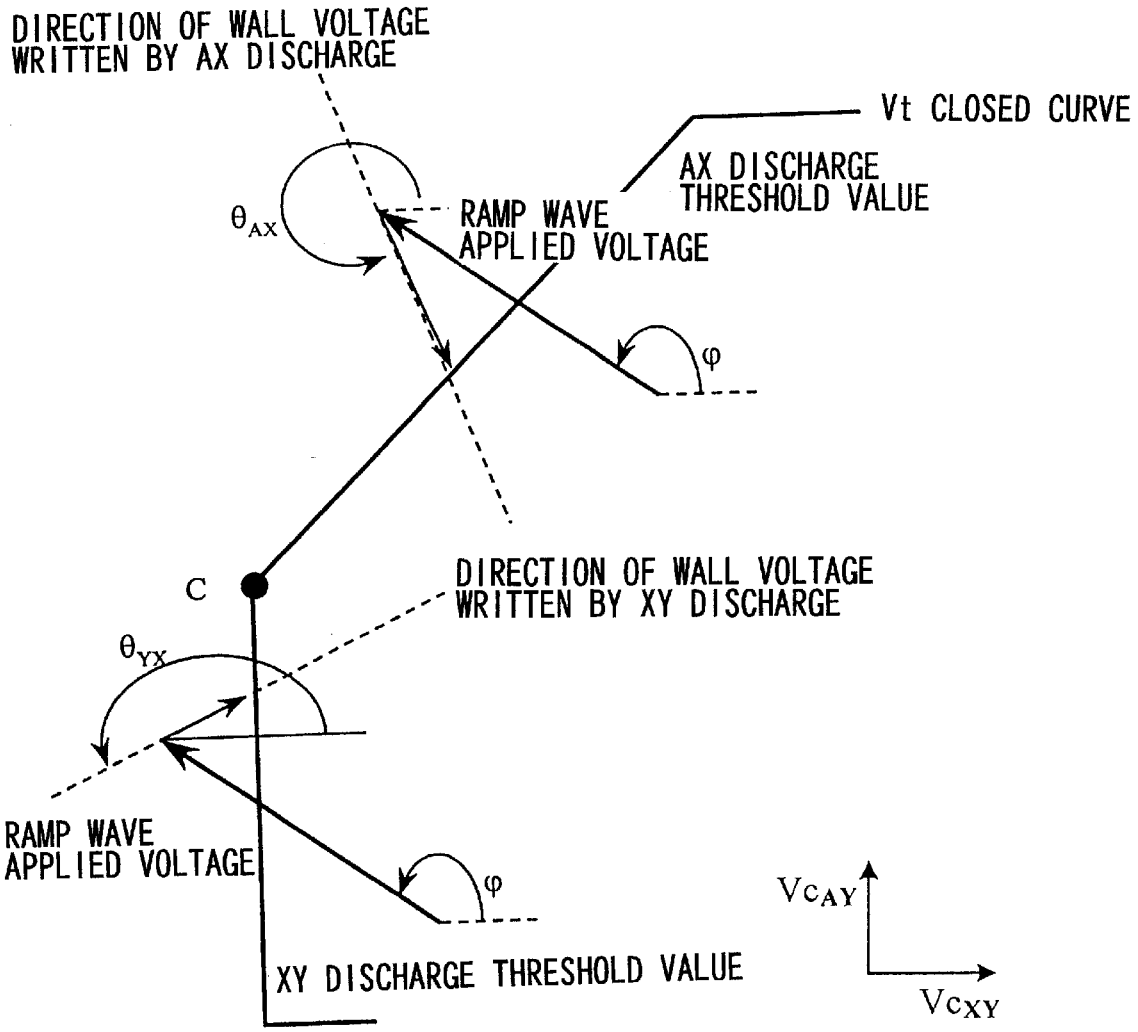
FIG. 16 shows a second example of the applied voltage vector.

The applied voltage vector in the example of FIG. 16 moves the cell voltage to the simultaneous discharge point C between A and X electrodes and between Y and X electrodes in which the electrode X is the cathode.

Figure 17:
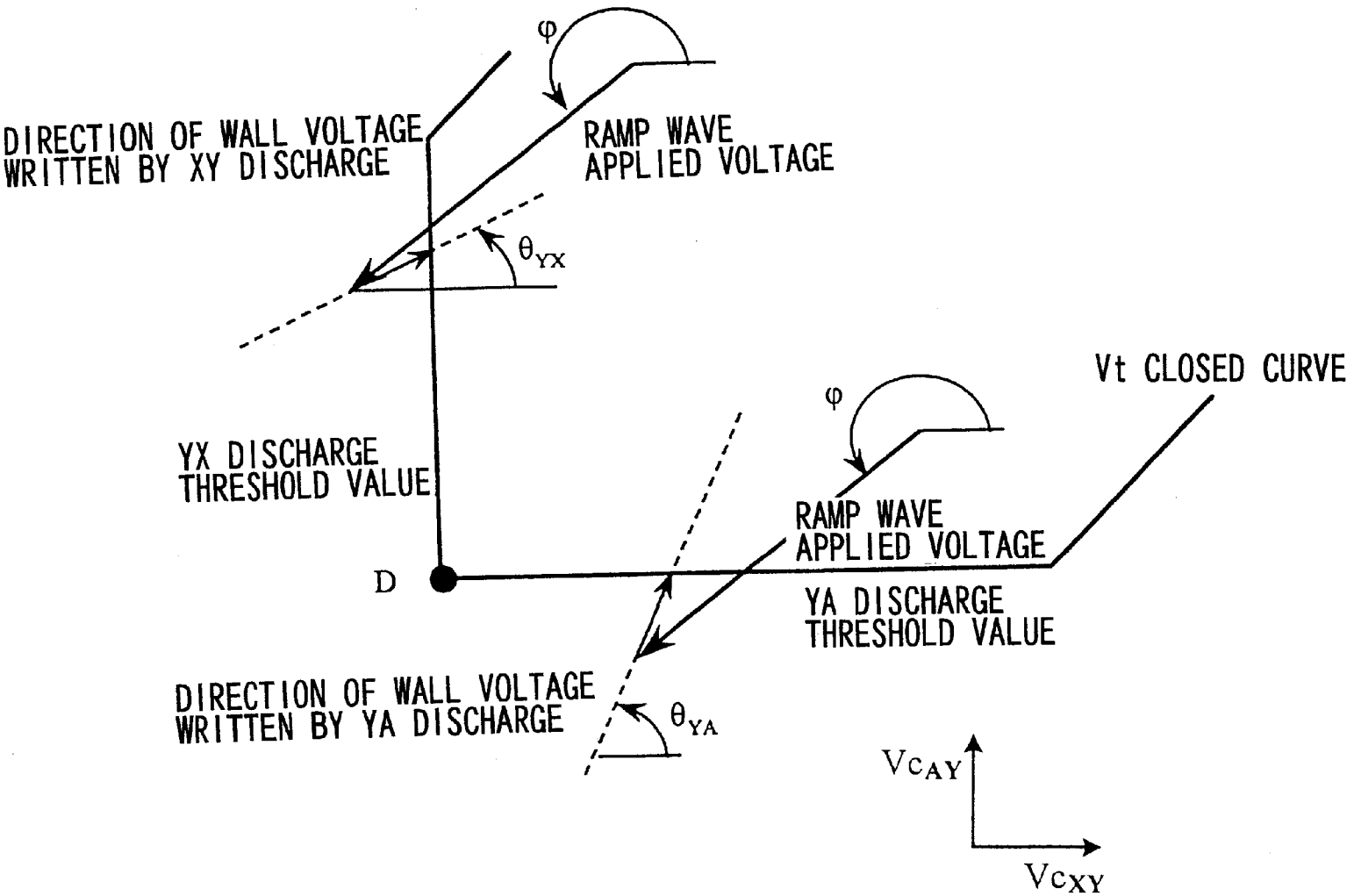
FIG. 17 shows a third example of the applied voltage vector.

The applied voltage vector in the example of FIG. 17 moves the cell voltage to the simultaneous discharge point D between Y and X electrodes and between Y and A electrodes in which the electrode Y is the anode.

Figure 18:
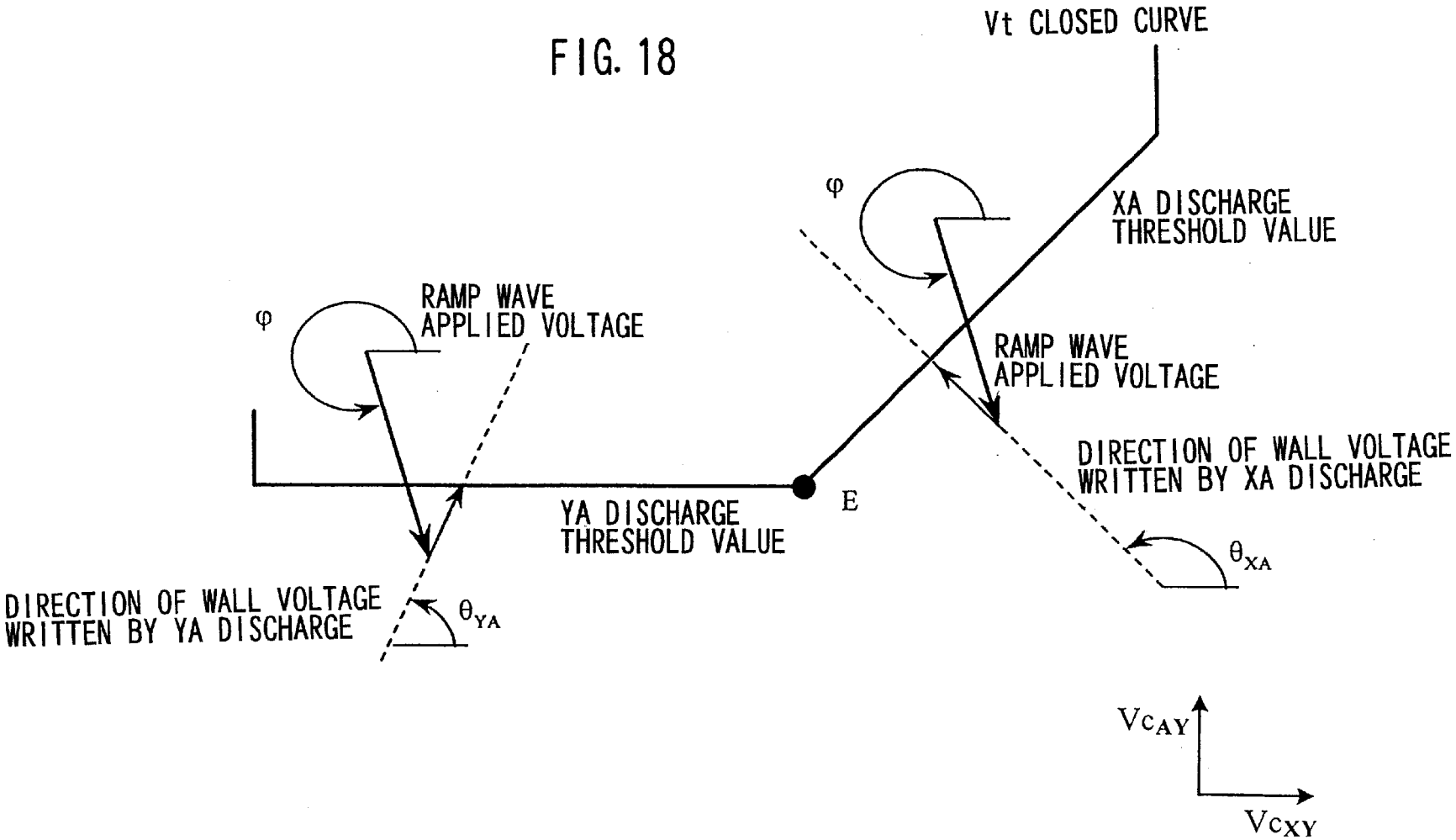
FIG. 18 shows a fourth example of the applied voltage vector.

The applied voltage vector in the example of FIG. 18 moves the cell voltage to the simultaneous discharge point E between Y and A electrodes and between X and A electrodes in which the electrode A is the cathode.

Figure 19:
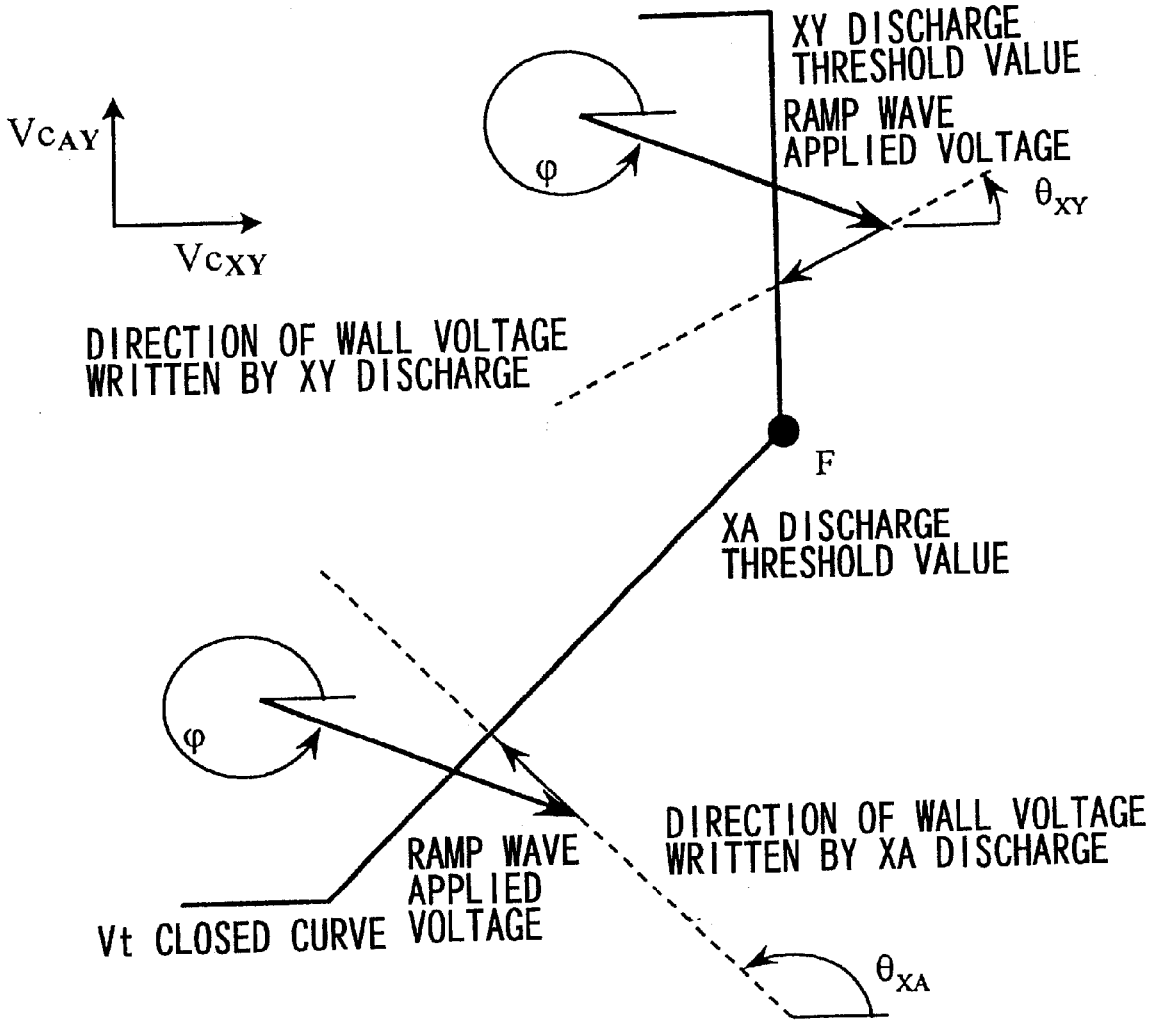
FIG. 19 shows a fifth example of the applied voltage vector.

The applied voltage vector in the example of FIG. 19 moves the cell voltage to the simultaneous discharge point F between X and A electrodes and between X and Y electrodes in which the electrode X is the anode.

Figure 20:
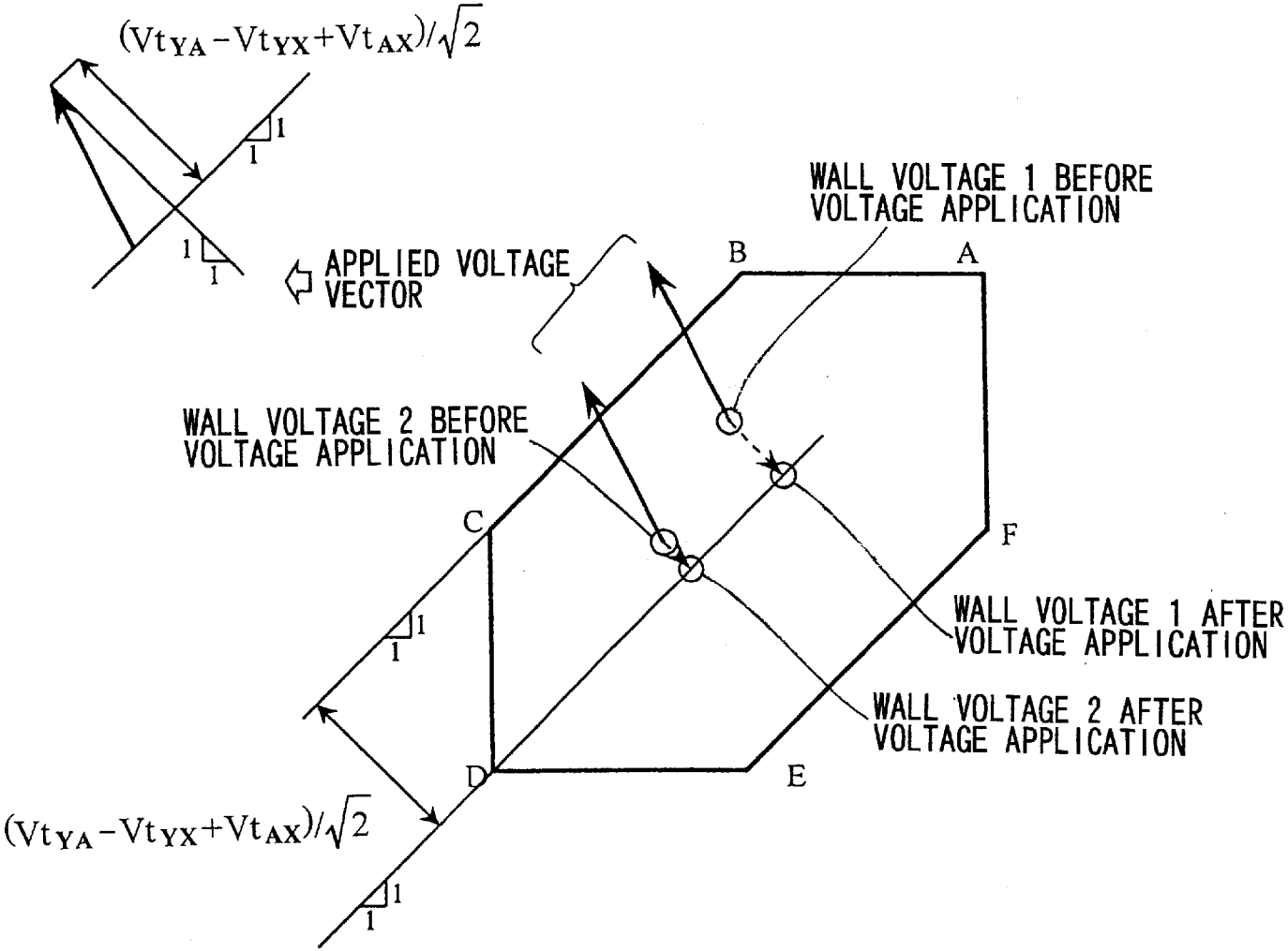
FIG. 20 shows a sixth example of the applied voltage vector.
Figure 21:
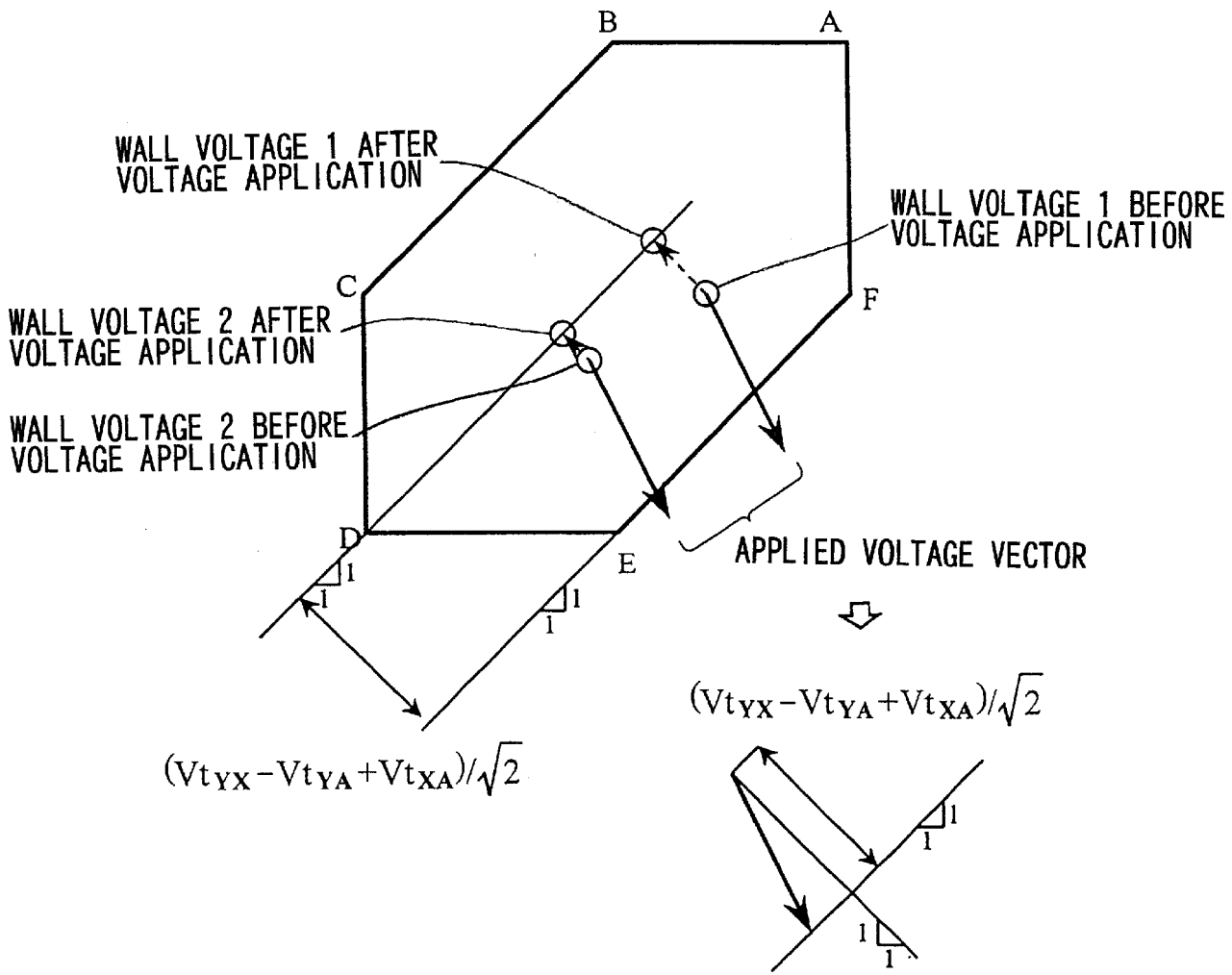
FIG. 21 shows a seventh example of the applied voltage vector.

The applied voltage vector in the example of FIG. 20 generates the AX discharge in which the electrode A is the anode as the first half operation in the case of moving the cell voltage to the simultaneous discharge point D between Y and X electrodes and between Y and A electrodes in which the electrode Y is the common anode. If the voltage that is applied between A and X electrodes in the first half operation is selected to be close to $Vt_{YA}-Vt_{YX}+Vt_{AX}$, the ramp voltage in the second half operation can generate the simultaneous discharge between Y and X electrodes and between Y and A electrodes in which the electrode Y is the common anode. The applied voltage vector in the example of FIG. 21 generates the XA discharge in which the electrode X is the anode as the first half operation in the case of moving the cell voltage to the simultaneous discharge point D between Y and X electrodes and between Y and A electrodes in which the electrode Y is the common anode. If the voltage that is applied between X and A electrodes in the first half operation is selected to be close to $Vt_{YX}-Vt_{YA}+Vt_{XA}$, the ramp voltage in the second half operation can generate the simultaneous discharge between Y and X electrodes and between Y and A electrodes in which the electrode Y is the common anode.

Figure 22:
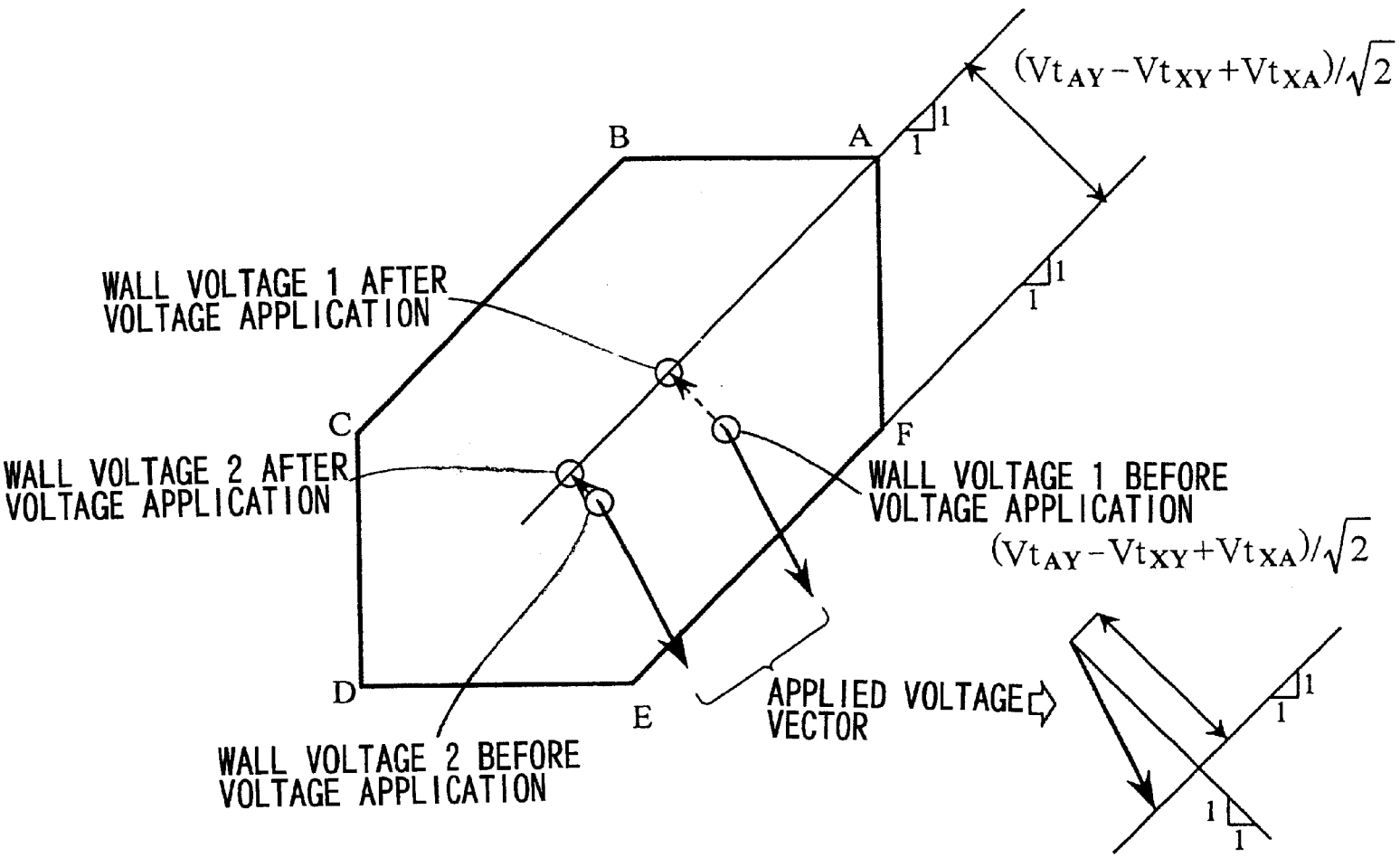
FIG. 22 shows an eighth example of the applied voltage vector.

The applied voltage vector in the example of FIG. 22 generates the XA discharge in which the electrode X is the anode as the first half operation in the case of moving the cell voltage to the simultaneous discharge point A between Y and X electrodes and between Y and A electrodes in which the electrode Y is the common cathode. If the voltage that is applied between X and A electrodes in the first half operation is selected to be close to $Vt_{AY}-Vt_{XY}+Vt_{XA}$, the ramp voltage in the second half operation can generate promptly the simultaneous discharge between Y and X electrodes and between Y and A electrodes in which the electrode Y is the common cathode.

Figure 23:
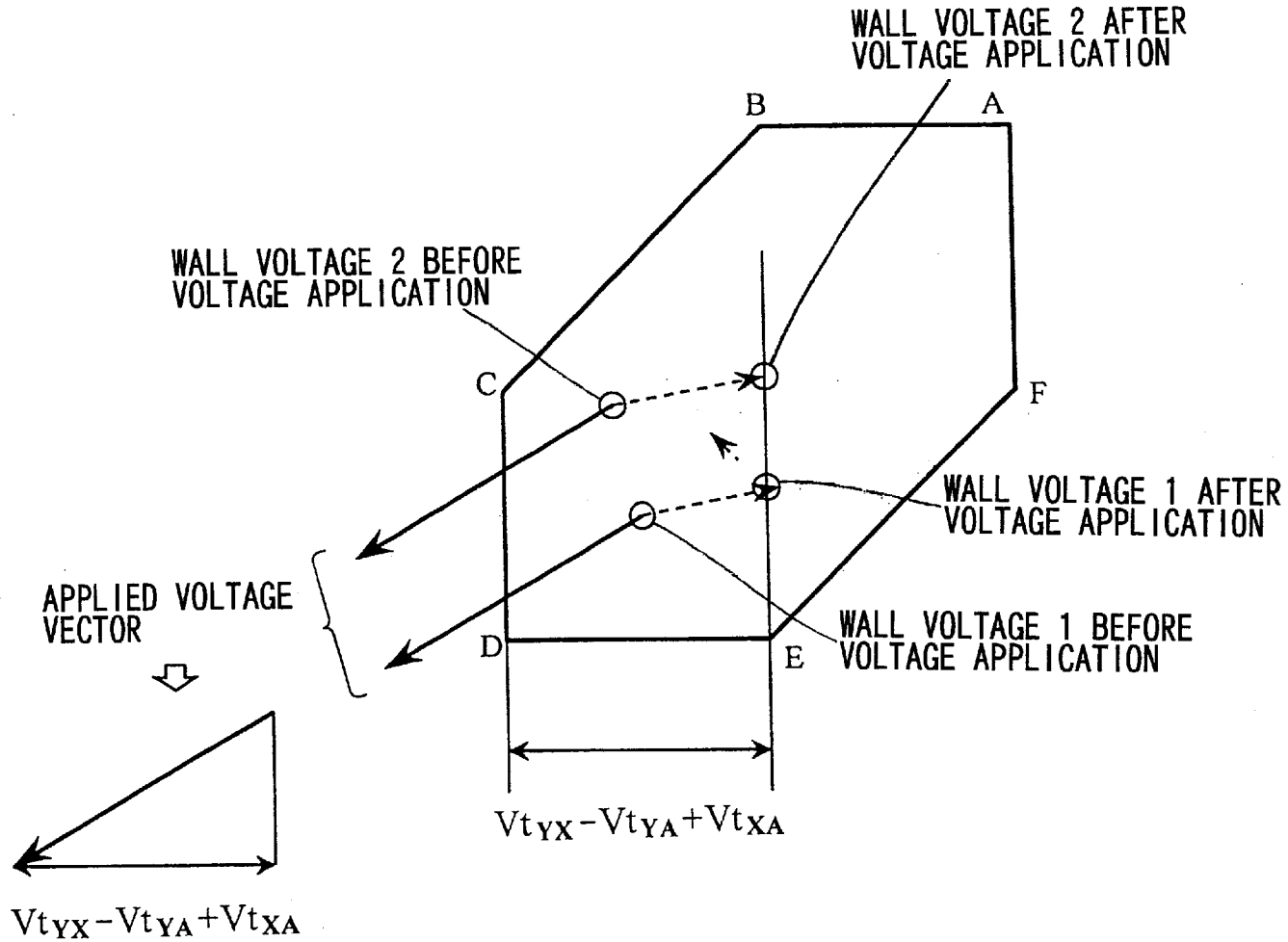
FIG. 23 shows a ninth example of the applied voltage vector.

The applied voltage vector in the example of FIG. 23 generates the YX discharge in which the electrode Y is the anode as the first half operation in the case of moving the cell voltage to the simultaneous discharge point E between X and A electrodes and between Y and A electrodes in which the electrode A is the common cathode. If the voltage that is applied between X and A electrodes in the first half operation is selected to be close to $Vt_{YX}-Vt_{YA}+Vt_{XA}$, the ramp voltage in the second half operation can generate the simultaneous discharge between X and A electrodes and between Y and A electrodes in which the electrode A is the common cathode.

Figure 24:
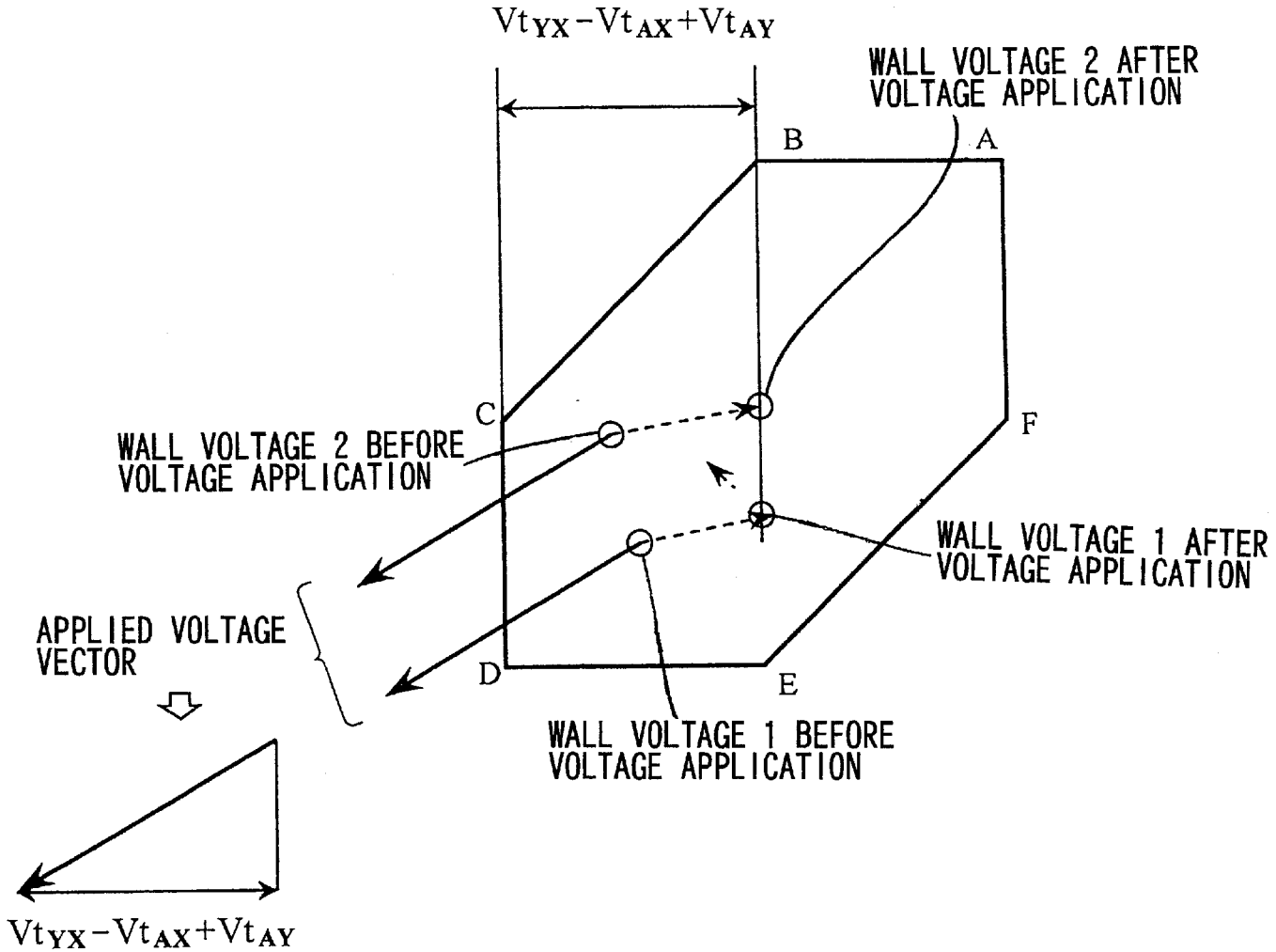
FIG. 24 shows a tenth example of the applied voltage vector.

The applied voltage vector in the example of FIG. 24 generates the YX discharge in which the electrode Y is the anode as the first half operation in the case of moving the cell voltage to the simultaneous discharge point B between A and X electrodes and between A and Y electrodes in which the electrode A is the common anode. If the voltage that is applied between Y and X electrodes in the first half operation is selected to be close to $Vt_{YX}-Vt_{AX}+Vt_{AY}$, the ramp voltage in the second half operation can generate the simultaneous discharge between A and X electrodes and between A and Y electrodes in which the electrode A is the common anode.

Figure 25:
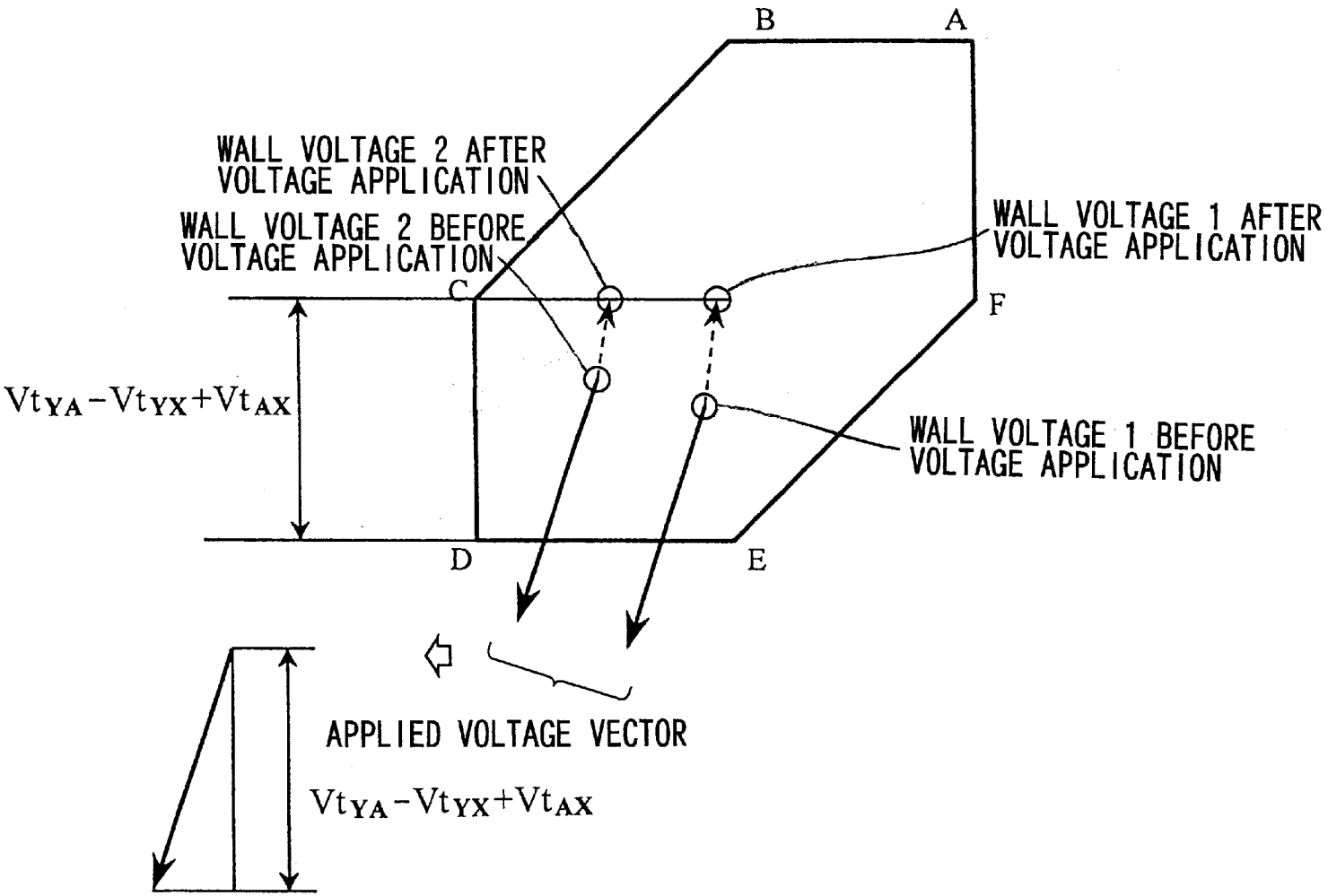
FIG. 25 shows an eleventh example of the applied voltage vector.

The applied voltage vector in the example of FIG. 25 generates the YA discharge in which the electrode Y is the anode as the first half operation in the case of moving the cell voltage to the simultaneous discharge point C between Y and X electrodes and between A and X electrodes in which the electrode X is the common cathode. If the voltage that is applied between Y and A electrodes in the first half operation is selected to be close to $Vt_{YA}-Vt_{YX}+Vt_{AX}$, the ramp voltage in the second half operation can generate the simultaneous discharge between Y and X electrodes and between A and X electrodes in which the electrode X is the common anode.

Figure 26:
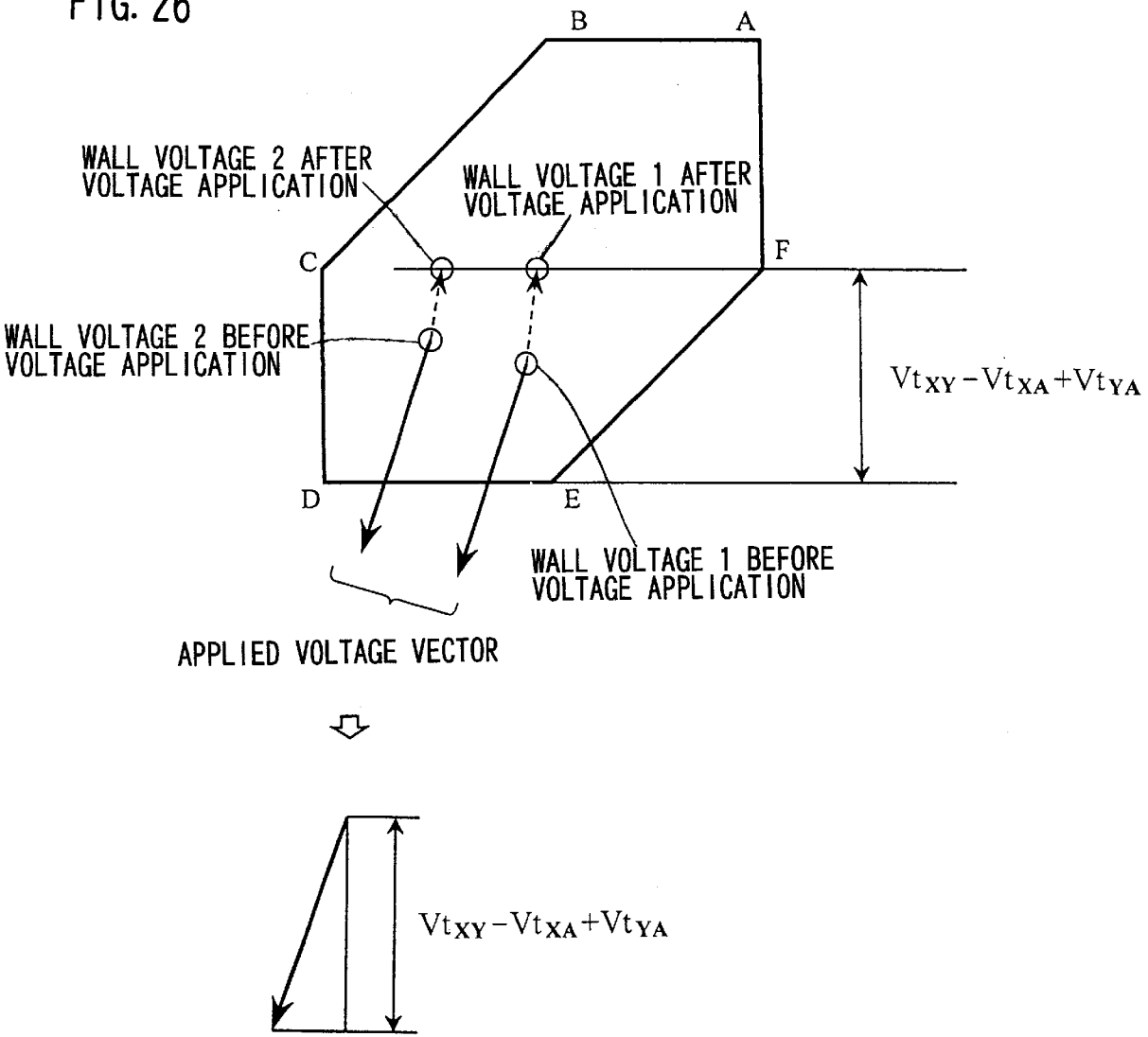
FIG. 26 shows a twelfth example of the applied voltage vector.

The applied voltage vector in the example of FIG. 26 generates the YA discharge in which the electrode Y is the anode as the first half operation in the case of moving the cell voltage to the simultaneous discharge point F between X and A electrodes and between X and Y electrodes in which the electrode X is the common anode. If the voltage that is applied between Y and A electrodes in the first half operation is selected to be close to $Vt_{XY}-Vt_{XA}+Vt_{YA}$, the ramp voltage in the second half operation can generate the simultaneous discharge between X and A electrodes and between Y and Y electrodes in which the electrode X is the common anode.

Figure 27:
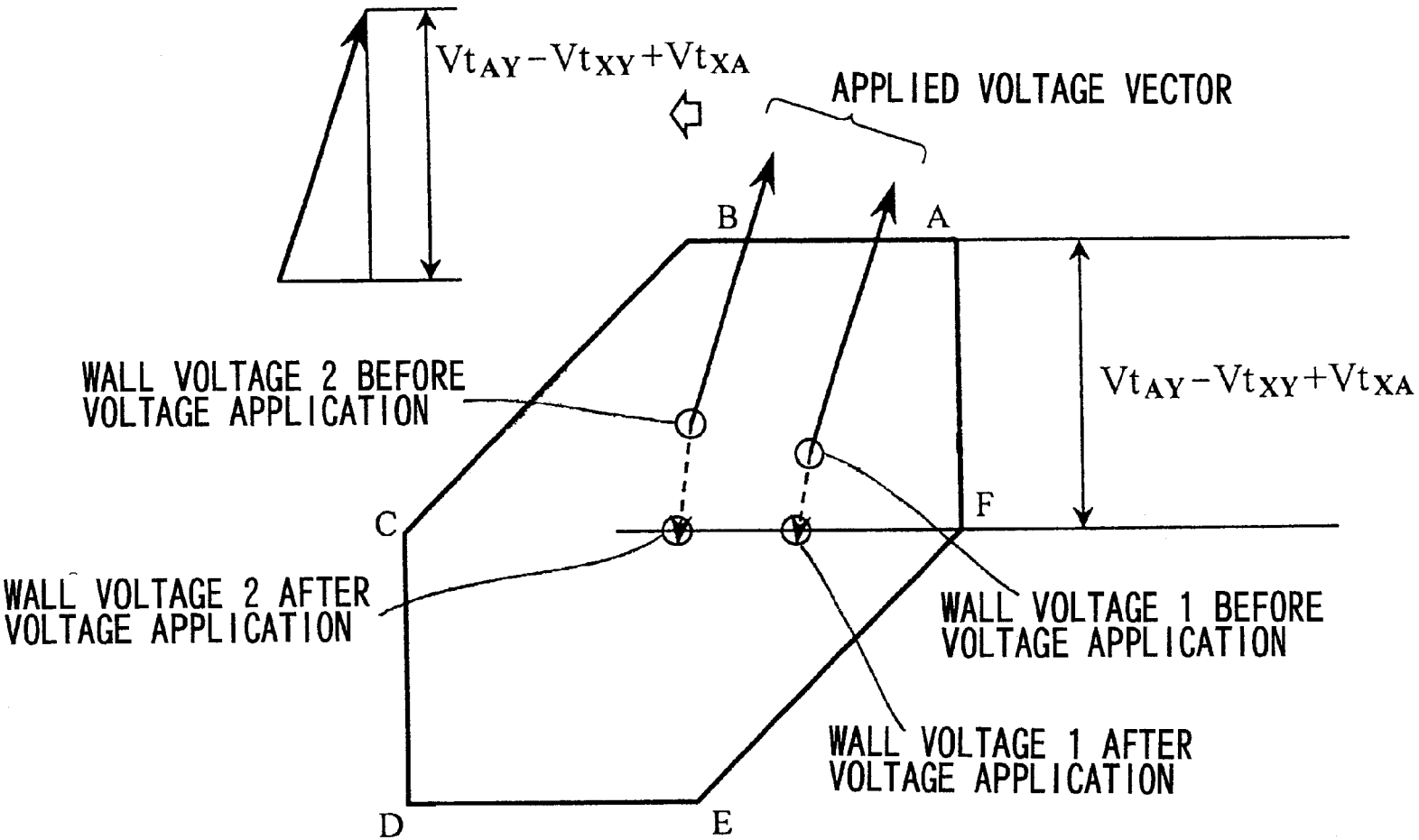
FIG. 27 shows a thirteenth example of the applied voltage vector.

The applied voltage vector in the example of FIG. 27 generates the AY discharge in which the electrode A is the anode as the first half operation in the case of moving the cell voltage to the simultaneous discharge point F between X and A electrodes and between X and Y electrodes in which the electrode X is the common anode. If the voltage that is applied between A and Y electrodes in the first half operation is selected to be close to $Vt_{AY}-Vt_{XY}+Vt_{XA}$, the ramp voltage in the second half operation can generate the simultaneous discharge between X and A electrodes and between X and Y electrodes in which the electrode X is the common anode.

Figure 28:
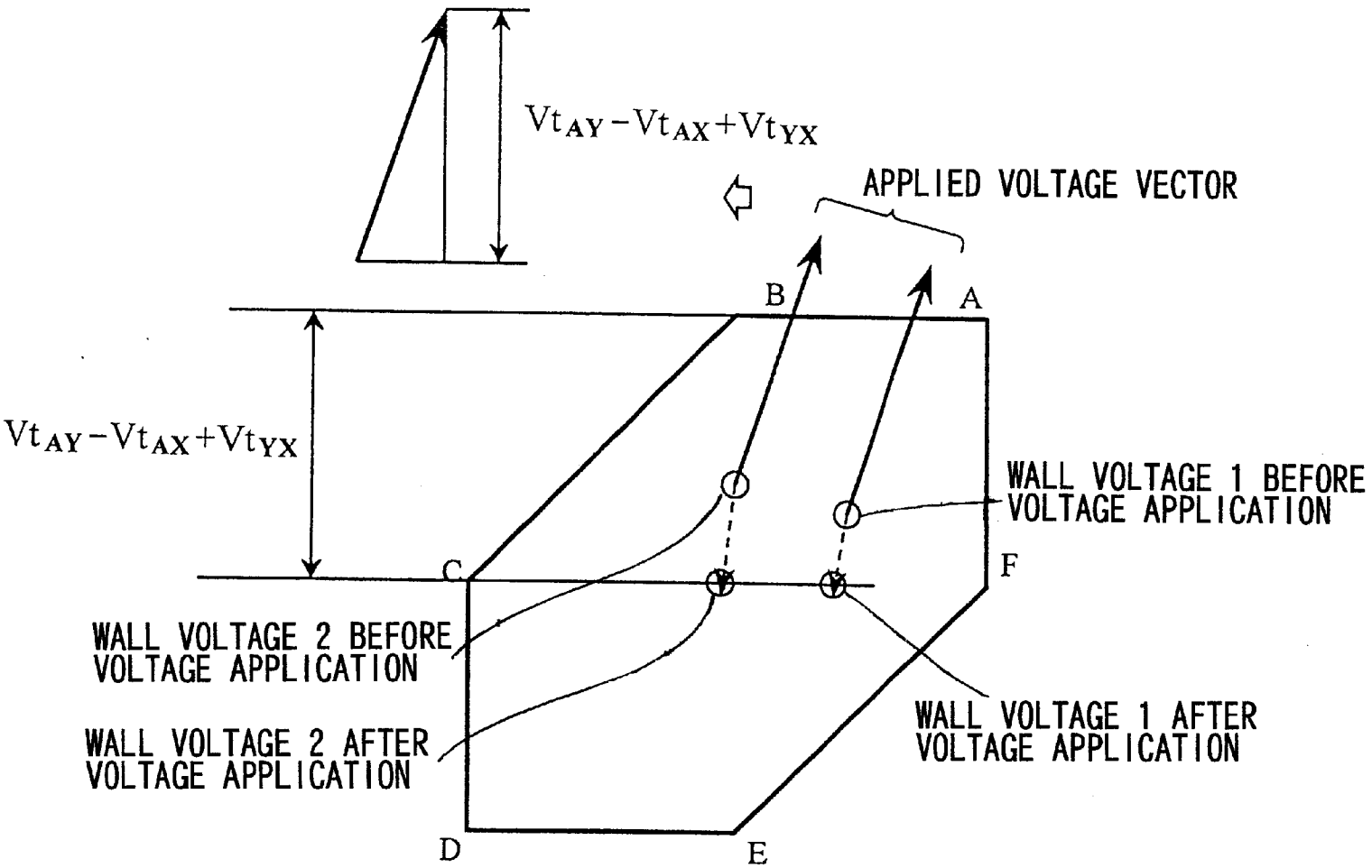
FIG. 28 shows a fourteenth example of the applied voltage vector.

The applied voltage vector in the example of FIG. 28 generates the AY discharge in which the electrode A is the anode as the first half operation in the case of moving the cell voltage to the simultaneous discharge point C between A and X electrodes and between Y and X electrodes in which the electrode X is the common anode. If the voltage that is applied between A and Y electrodes in the first half operation is selected to be close to $Vt_{AY}-Vt_{AX}+Vt_{YX}$, the ramp voltage in the second half operation can generate the simultaneous discharge between Y and X electrodes and between Y and A electrodes in which the electrode X is the common anode.

Figure 29:
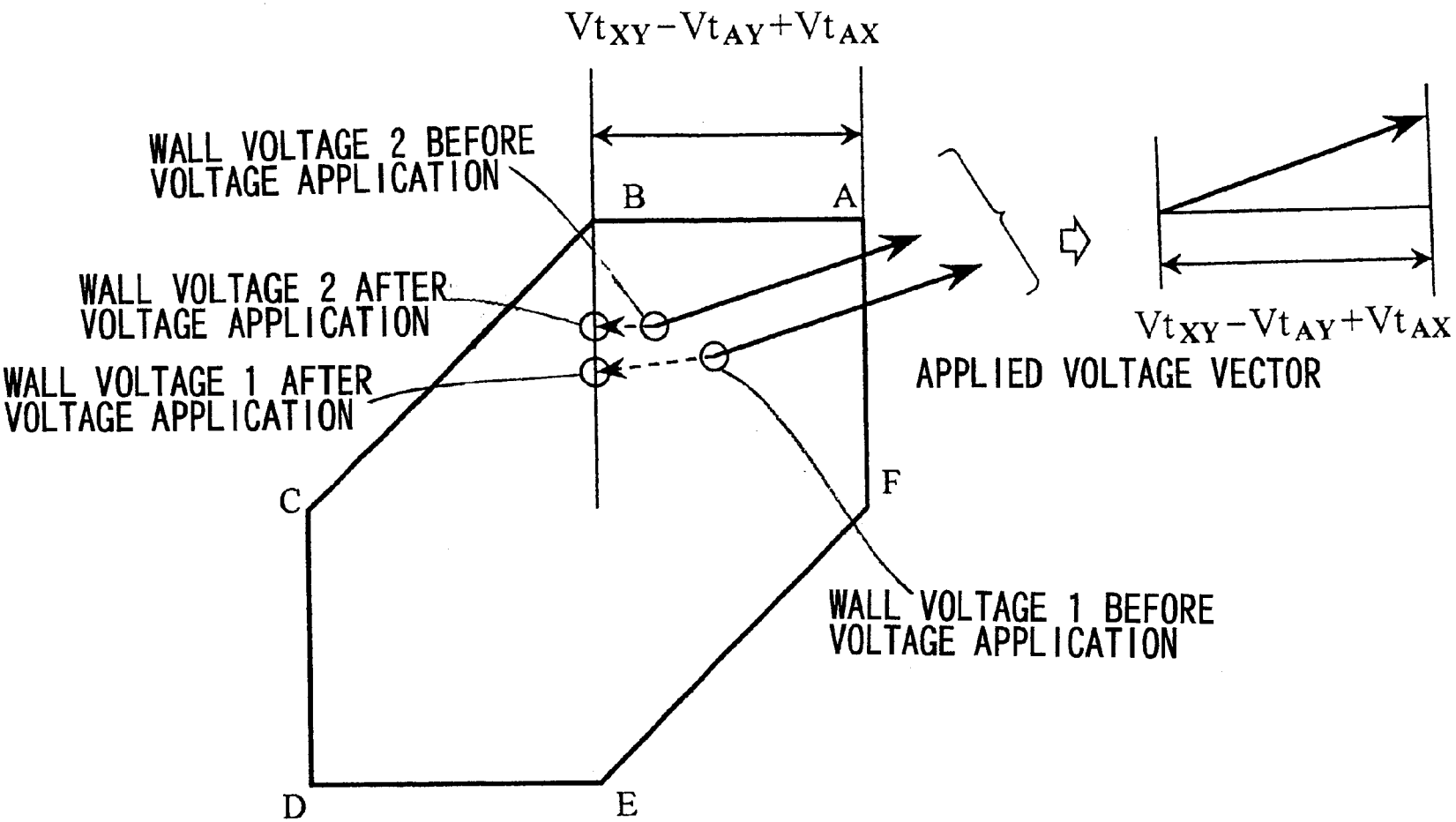
FIG. 29 shows a fifteenth example of the applied voltage vector.

The applied voltage vector in the example of FIG. 29 generates the XY discharge in which the electrode X is the anode as the first half operation in the case of moving the cell voltage to the simultaneous discharge point B between A and Y electrodes and between A and X electrodes in which the electrode A is the common anode. If the voltage that is applied between X and Y electrodes in the first half operation is selected to be close to $Vt_{XY}-Vt_{AY}+Vt_{AX}$, the ramp voltage in the second half operation can generate the simultaneous discharge between A and Y electrodes and between A and X electrodes in which the electrode A is the common anode.

Figure 30:
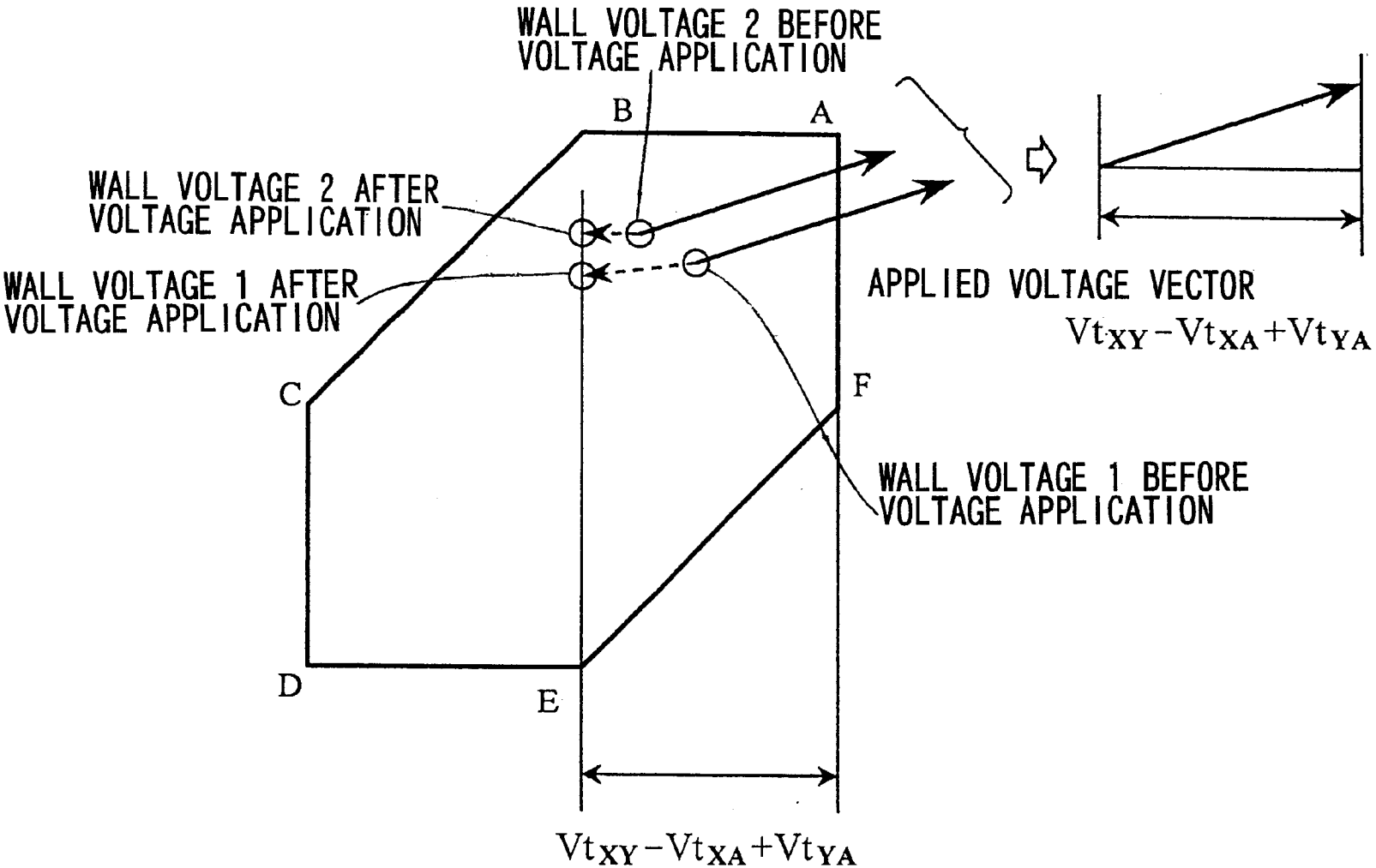
FIG. 30 shows a sixteenth example of the applied voltage vector.

The applied voltage vector in the example of FIG. 30 generates the XY discharge in which the electrode X is the anode as the first half operation in the case of moving the cell voltage to the simultaneous discharge point E between X and A electrodes and between Y and A electrodes in which the electrode A is the common anode. If the voltage that is applied between X and Y electrodes in the first half operation is selected to be close to $Vt_{XY}-Vt_{XA}+Vt_{YA}$, the ramp voltage in the second half operation can generate the simultaneous discharge between X and A electrodes and between Y and A electrodes in which the electrode A is the common anode.

Plural applied voltage vector are selected from the above-mentioned examples and are combined so as to make plural stages of initialization step. Thus, the reliability of the initialization can be improved. However, since the time necessary for the initialization step increases along with the increase of the number of stages, it is desirable that the number of stages is as small as possible. In order to shorten the total time necessary for the initialization of one field, at least two initialization steps having different numbers of stages should be combined.

Figure 31:
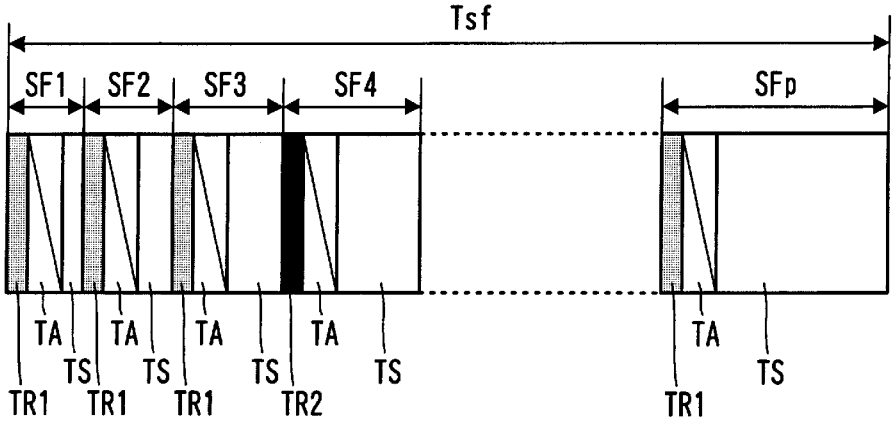
FIG. 31 shows a first example of an execution timing of plural initialization.

The field period Tsf in the sequence shown in FIG. 31 includes a preparation period TR1 for performing the initialization by a first voltage application pattern and a preparation period TR2 for performing the initialization by a second voltage application pattern having more stages than the first voltage application pattern. One subfield (the subfield 4) is assigned to the preparation period TR2, and other plural subfields are assigned to the preparation period TR1. Namely, more assured initialization is performed by one time per one field. Any subfield can be assigned to the preparation period TR1.

Figure 32:
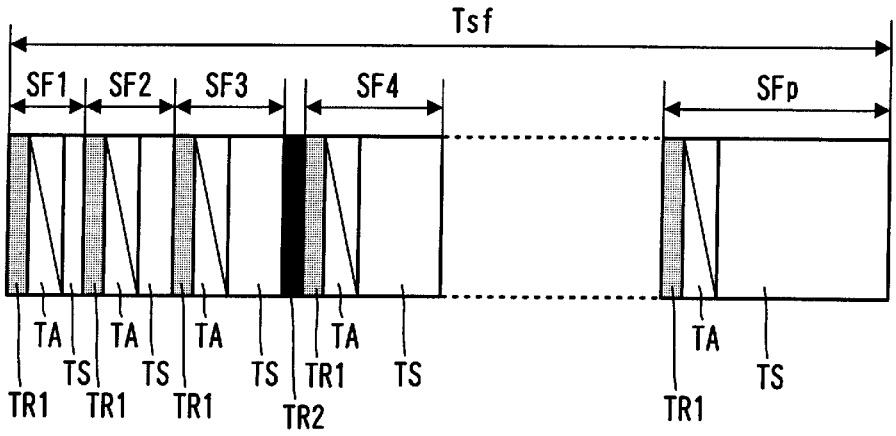
FIG. 32 shows a second example of an execution timing of plural initialization.
Figure 33:
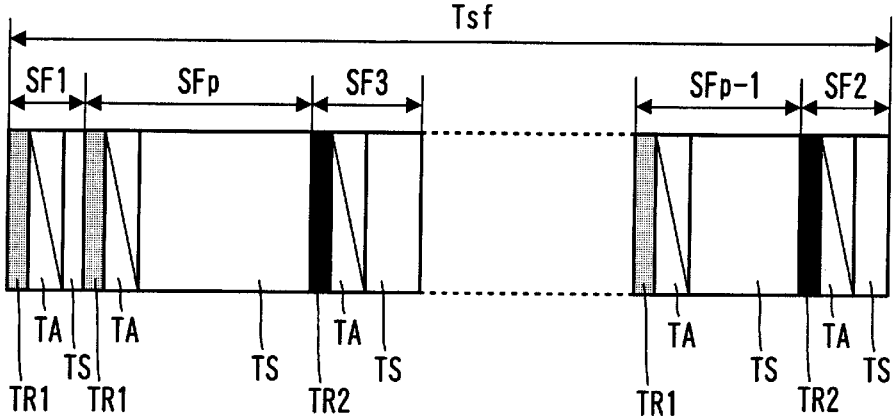
FIG. 33 shows a third example of an execution timing of plural initialization.

In the example of FIG. 32, each subfield is assigned to the preparation period TR1. In addition, one preparation period TR2 is assigned to each field. In general, the larger the number of the display pulses in the display process is, the more the initialization becomes insufficient. In the example of FIG. 33, the initialization steps having different numbers of stages are used discriminately for the subfield following the subfield having relatively large number of display pulses in one field and for the subfield following the subfield having relatively small number of display pulses.

Figure 34:
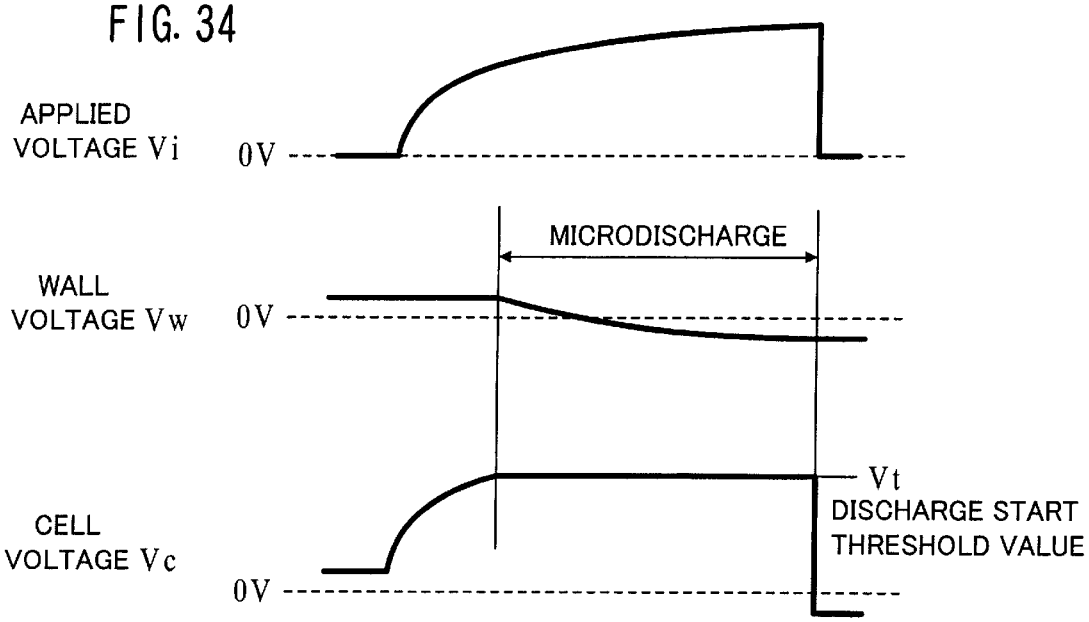
FIG. 34 shows waveforms of another example of the increasing voltage.
Figure 35:
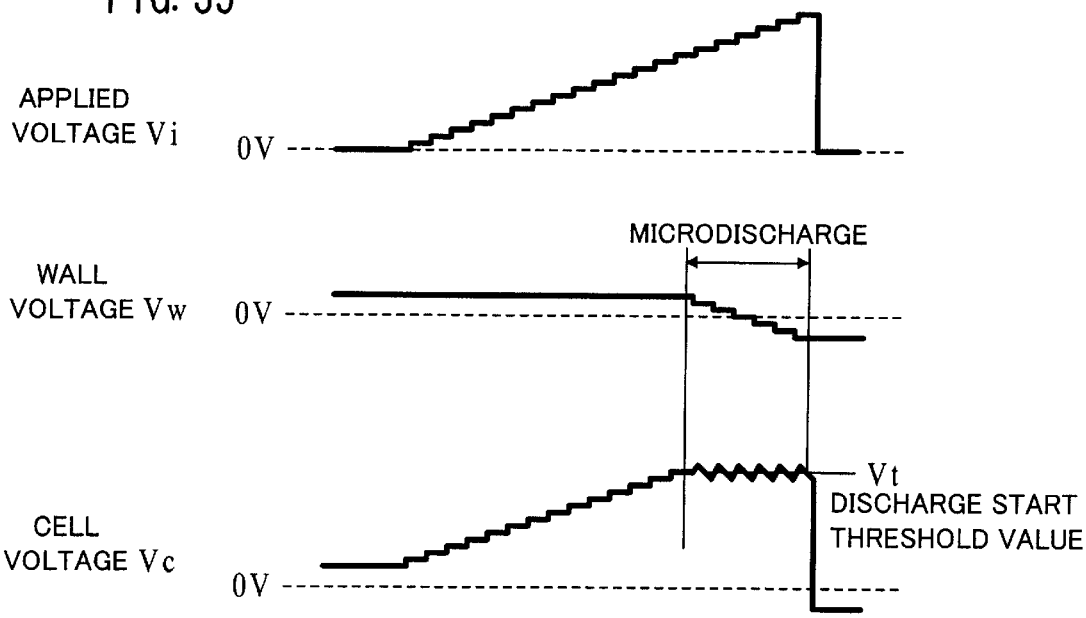
FIG. 35 shows waveforms of another example of the increasing voltage.
Figure 36:
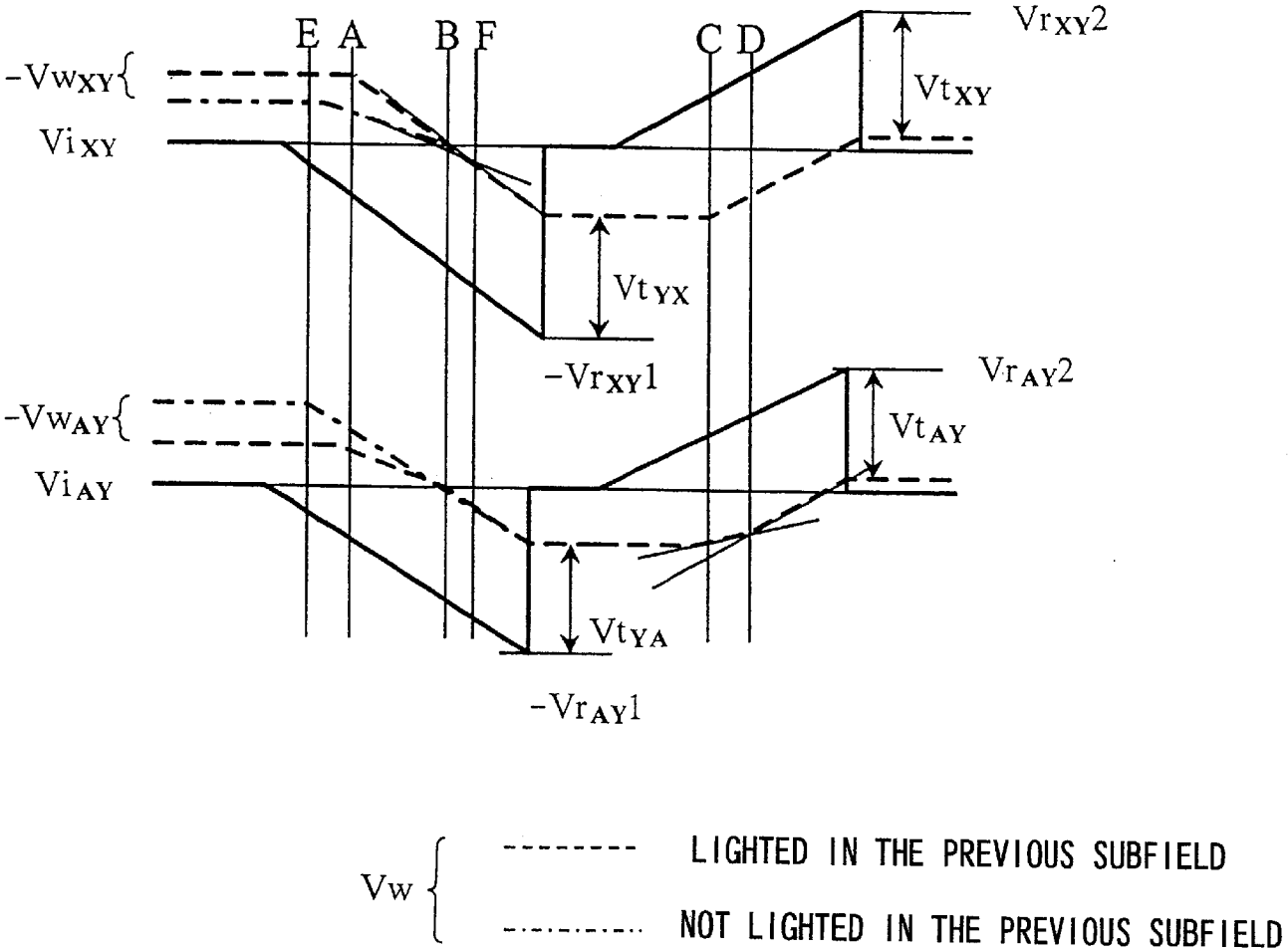
FIG. 36 PRIOR ART
FIG. 36 is a diagram for explaining the conventional initialization.
Figure 38A:
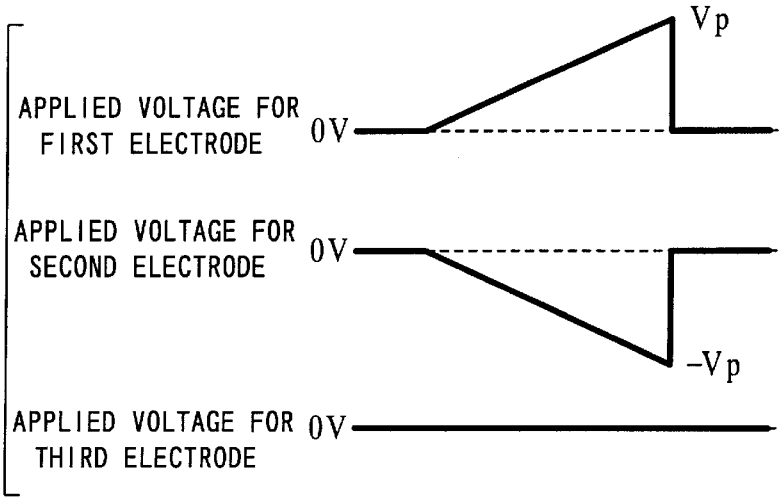
FIG. 38A PRIOR ART
FIGS. 38A and 38B show a second example of the applied voltage waveform that cannot generate the simultaneous discharge.
Figure 38B:
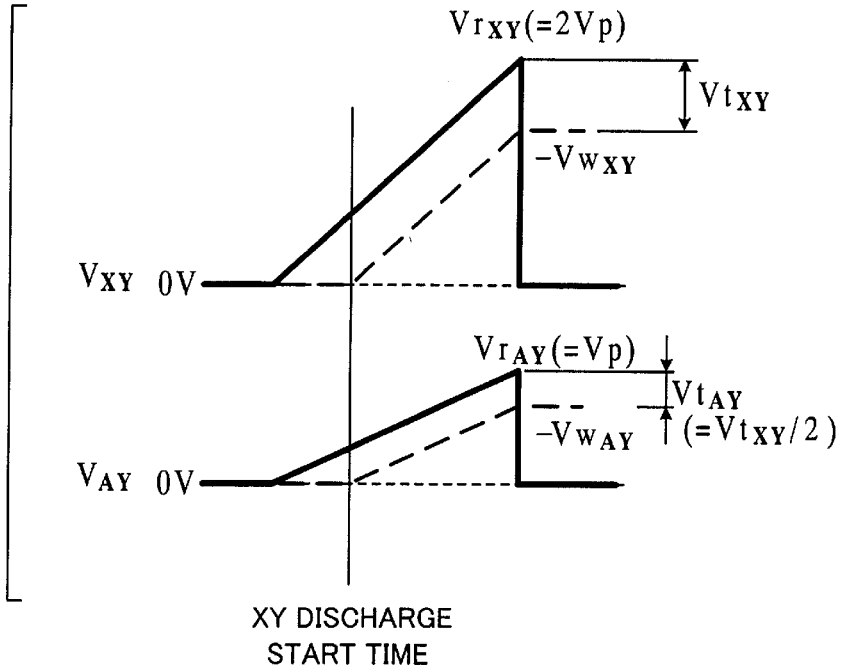
FIG. 38B PRIOR ART

In the above-mentioned embodiment, an increasing voltage having the obtuse waveform as shown in FIG. 34 or the step waveform as shown in FIG. 35 can be applied instead of the ramp voltage. However, when applying the obtuse waveform, the cell voltage should not reach the discharge starting threshold value voltage before the voltage change rate becomes below the value that can generate the microdischarge. When applying the step waveform, the voltage change quantity and the time width of one step should be determined so that the microdischarge occurs periodically. As far as satisfying the condition of the generation of the microdischarge, the voltage change quantity and the time width can be different for each step. The direction of the voltage change can be changed by the discharge temporarily due to the influence of the power source impedance. In addition, other voltage waveforms except the above-mentioned examples can be adopted as far as the waveform can generate the microdischarge.

According to the present invention, the wall voltage can be adjust to a target value, so that the driving voltage margin can be increased.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A method for setting an applied voltage in a plasma display panel having discharge cells with at least three electrodes whose potentials can be controlled independently, the method comprising:

determining a range of voltages, that can generate a charge adjustment discharge to set a wall charge quantity, by defining, in a coordinates space, a closed loop relationship between an effective voltage in a first interelectrode spacing and an effective voltage in a second interelectrode spacing; and determining a waveform of an increasing voltage that is applied to a discharge cell to generate the charge adjustment discharge in accordance with the voltage range.

2. The method according to claim 1, wherein the waveform of the increasing voltage is determined in accordance with the voltage range so that a light emission quantity of the charge adjustment discharge is minimized.

3. A method for driving a plasma display panel having discharge cells with at least three electrodes whose potentials can be controlled independently, wherein a charge adjustment discharge changing a wall charge quantity to compensate for variations in discharge starting threshold value voltages between the discharge cells is generated simultaneously in at least two interelectrode spacings of each discharge cell as a preparation process of addressing.

4. The method according to claim 3, wherein the charge adjustment discharge is generated by applying a voltage increasing at a constant rate.

5. The method according to claim 3, wherein the charge adjustment discharge is generated by applying a voltage having an obtuse waveform whose change rate decreases gradually.

6. The method according to claim 3, wherein the charge adjustment discharge is generated by applying a voltage having a step waveform increasing step by step.

7. The method according to claim 3, wherein the charge adjustment discharge is generated by applying a voltage having a waveform whose change rate is larger in a period while an effective voltage across an interelectrode spacing that is an application target does not exceed a discharge start voltage than in a period while the effective voltage exceeds the discharge start voltage.

8. The method according to claim 3, wherein the charge adjustment discharge is generated by applying a voltage having a waveform that increases step by step in a period while an effective voltage across an interelectrode spacing that is an application target does not exceed a discharge start voltage and increases gradually in a period while the effective voltage exceeds the discharge start voltage.

9. A method for driving a plasma display panel having discharge cells with at least three electrodes whose potentials can be controlled independently, wherein a charge adjustment discharge to change a wall charge quantity is generated simultaneously in at least two interelectrode spacings of each discharge cell as a preparation process of addressing, the charge adjustment discharge is generated in a first interelectrode spacing as well as in a second interelectrode spacing in each discharge cell, and after the charge adjustment discharge is generated in the first interelectrode spacing as well as in the second interelectrode spacing, the charge adjustment discharge is generated in the first interelectrode spacing as well as in a third interelectrode spacing in each discharge cell as the preparation process of the addressing.

10. The method according to claim 9, wherein a change of the voltage that is applied to generate the charge adjustment discharge both in the first interelectrode spacing and in the second interelectrode spacing is substantially the same as a change of the voltage that is applied to generate the charge adjustment discharge both in the first interelectrode spacing and in the third interelectrode spacing.

11. A method for driving a plasma display panel having discharge cells with at least three electrodes whose potentials can be controlled independently, wherein a charge adjustment discharge to change a wall charge quantity is generated simultaneously in at least two interelectrode spacings of each discharge cell as a preparation process of addressing, the preparation process includes plural steps having different voltage applications among three electrodes.

12. A method for driving a plasma display panel having discharge cells with at least three electrodes whose potentials can be controlled independently, wherein a charge adjustment discharge to change a wall charge quantity is generated simultaneously in at least two interelectrode spacings of each discharge cell as a preparation process of addressing, the display is a gradation display in which a field of display information includes plural subfields having a weighted luminance, and each of the plural subfields includes two subfields performing the preparation processes having different contents.

13. The method according to claim 12, wherein the field has plural subfields including a subfield performing the preparation process including three steps and a subfield performing the preparation process including two steps.

14. The method according to claim 13, wherein the preparation process including three steps is performed in a subfield having the largest weight of luminance.

15. A display device comprising:

a plasma display panel having a screen formed by discharge cells with at least three electrodes whose potentials can be controlled independently; and a drive circuit to generate charge adjustment discharges simultaneously that change a wall charge quantity in at least two interelectrode spacings of each discharge cell as a preparation process of an addressing without changing a polarity of a charging in the at least two interelectrode spacings to compensate for variations in discharge starting threshold value voltages between the discharge cells.

16. A method for setting an applied voltage in a plasma display panel having discharge cells with at least three electrodes whose potentials can be controlled independently, the method comprising:

defining in a coordinate space the relationship between an effective voltage across a first interelectrode spacing and an effective voltage across a second interelectrode spacing;

determining a range of voltages that can generate a charge adjustment discharge to set a wall charge quantity based on said coordinate space; and determining a waveform of an increasing voltage that is applied to the discharge cell to generate the charge adjustment discharge in accordance with said determining a range of voltage.

17. The method according to claim 16, wherein the waveform of the increasing voltage is determined in accordance with the voltage range so that a light emission quantity of the charge adjustment discharge is minimized.

* * * * *